US006860111B2

(12) United States Patent
Sanuki et al.

(10) Patent No.: US 6,860,111 B2
(45) Date of Patent: Mar. 1, 2005

(54) AUTOMATIC ICE MAKER AND ITS OPERATING METHOD

(75) Inventors: Masao Sanuki, Toyoake (JP); Chiyoshi Toya, Toyoake (JP); Fumio Maruyama, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 0 days.

(21) Appl. No.: 10/706,399

(22) Filed: Nov. 12, 2003

(65) Prior Publication Data

US 2004/0093878 A1 May 20, 2004

(30) Foreign Application Priority Data

Nov. 13, 2002 (JP) ..... 2002-329999

(51) Int. Cl.[7] ..... F25C 1/12
(52) U.S. Cl. ..... 62/74; 62/347
(58) Field of Search ..... 62/74, 347

(56) References Cited

U.S. PATENT DOCUMENTS 4,474,023 A * 10/1984 Mullins, Jr. ..... 62/137

6,062,036 A * 5/2000 Hobelsberger ..... 62/347

* cited by examiner

*Primary Examiner*—William E. Tapolcai
(74) *Attorney, Agent, or Firm*—Koda & Androlia

(57) ABSTRACT

There are disclosed an automatic ice maker and its operating method. A pair of ice making chambers are longitudinally arranged to face each other across a cooling tube. A plurality of ice making compartments are defined in each ice making chamber. On the open side of the ice making chamber, water trays for opening/closing the ice making chamber are arranged in parallel to be laterally moved. The water tray is moved between an ice making position for closing the ice making chamber and an open position for opening the ice making chamber by an opening/closing device. When a deicing operation is carried out, the water tray is laterally moved to the open position while ice cubes are frozen thereto to remove the ice cubes from the ice making compartments, and the cubes are deiced from the water tray in this open position.

11 Claims, 20 Drawing Sheets

AUTOMATIC ICE MAKER AND ITS OPERATING METHOD

FIELD OF THE INVENTION

The present invention relates to an automatic ice maker and its operating method, and more particularly to an automatic ice maker adapted to remove a lump of ice produced between an ice making section and ice making water feeding means from the ice making section while it is frozen in the ice making water feeding means, and its operating method.

DESCRIPTION OF THE RELATED ART

As an automatic ice maker for continuously producing a large amount of lumps of ice of required shapes, there has been known a vertical ice maker which closes an ice making chamber having a plurality of ice making compartments open in a horizontal direction from the side by a tiltable water tray so that it can be opened, and feeding ice making water by injection from the water tray to each ice making compartment to gradually form a lump of ice therein (e.g., see Japanese Patent Application Laid-Open No. 136101/1996).

In the vertical ice maker described above, since the water tray which opens/closes the ice making chamber is adapted to tilt, the water tray must be greatly tilted to deice the lump of ice produced in the ice making compartment on a tilting supporting point side, and thus large space is necessary for tilting the water tray. Therefore, enlargement of an ice making mechanism section is pointed out as a drawback. Additionally, the vertical ice maker is adapted to. deice the lump of ice from the ice making chamber with the water tray being tilted to open the ice making chamber. Thus, a horizontal partition which defines the ice making compartment is tilted downward, and the lump of ice in which a frozen surface with the ice making compartment has been melted is slid on the horizontal partition to be discharged to an ice storage.

As described above, in the constitution in which the lump of ice is deiced obliquely downward from the ice making compartment, it is necessary to set large an opening size of an ice dropping port which is formed in an ice making water tank arranged below the ice making compartment to drop the lump of ice to the ice storage. Thus, storage of the necessary amount of ice making water in the ice making water tank results in enlargement of the ice making water tank by an amount equivalent to the opening size. Therefore, enlargement of the ice maker itself is pointed out as a problem.

SUMMARY OF THE INVENTION

The present invention is presented with the foregoing drawbacks in mind to properly solve them, and objects of the invention are to downsize an ice maker, and to provide an automatic ice maker capable of producing many lumps of ice in a small installation area and its operating method.

In order to overcome the foregoing problems and to properly achieve the intended objects, an automatic ice maker according to an aspect of the present invention comprises:

a longitudinally arranged ice making section having multiple ice making compartments open in a horizontal direction;

a cooling tube which is arranged on a backside of the ice making section to be in close contact therewith and through which a refrigerant is circulated when an ice making operation is carried out and a high-temperature refrigerant gas is circulated when a deicing operation is carried out; and ice making water feeding means positioned in ice making positions for closing the ice making compartments when the ice making operation is carried out to feed ice making water to the ice making compartments, thereby producing lumps of ice, and laterally moved in parallel to an open position for opening the ice making compartments by opening/closing means when the deicing operation is carried out, wherein the ice making water feeding means are laterally moved to the open positions while the lumps of ice are frozen thereto to remove the lumps of ice from the ice making compartments when the deicing operation is carried out, and the lumps of ice are deiced from the ice making water feeding means in the open positions.

In order to overcome the foregoing problems and to achieve the intended objects, an automatic ice maker according to another aspect of the present invention comprises:

a longitudinally arranged ice making section having an ice making compartment open in an obliquely downward direction, which is cooled when an ice making operation is carried out, heated when a deicing operation is carried out;

an ice making water feeding means positioned in an ice making position for closing the ice making compartment when the ice making operation is carried out to feed ice making water to the ice making compartment, thereby producing a lump of ice, and set apart from the ice making section to be laterally moved to the open position for opening the ice making compartment when the deicing operation is carried out; and an opening/closing means which comprises a second engaging section to be engaged with a first engaging section of the ice making water feeding means, and which is displaceable between a first position for engaging the second engaging section with the first engaging section to hold the ice making water feeding means in the ice making position when the ice making operation is carried out and a second position for disengaging the second engaging section from the first engaging section to laterally move the ice making water feeding means to the open position by its own weight when the deicing operation is carried out, wherein when a frozen surface between the ice making section and the lump of ice heated by the deicing operation is melted after the second engaging section is displaced from the first position to the second position by the opening/closing means, the ice making water feeding means is laterally moved by its own weight while the lump of ice is frozen to be held in the open position for engaging the first engaging section with the second engaging section, and wherein the ice making water feeding means is laterally moved from the open position to the ice making position under the engaging action between the first engaging section and the second engaging action when the second engaging section is displaced from the second position to the first position by the opening/closing means.

In order to overcome the foregoing problems and to achieve the intended objects, a method for operating an automatic ice maker according to yet another aspect of the present invention, the automatic ice maker comprising a longitudinally arranged ice making section which is cooled when an ice making operation is carried out, and heated when a deicing operation is carried out; and a plurality of ice making water feeding means which face an ice making position close to the ice making section to produce a lump of ice between the means and the ice making section during the ice making operation, and laterally move to an open position to be apart from the ice making section by switching to a deicing operation, comprises:

moving the ice making water feeding means while the lump of ice is frozen, and heating the ice making water feeding means to deice the lump of ice when the deicing operation is carried out; and carrying out an operation to deal with an abnormality, which returns the ice making water feeding means to the open position to resume the deicing operation if a detection means for detecting an arrival of the ice making water feeding means at the ice making position is not set in a detection state even after the passage of normal time necessary from a start of movement of the ice making water feeding means of the open position toward the ice making position by transfer from the deicing operation to an ice making operation to return of the ice making water feeding means after normal deicing of the lump of ice to the ice making position.

BRIEF DESCRIPTION OF THE DRAWINGS

FIG. 19A showing a state in which the water tray is positioned in the ice making position, and the detection member is positioned in a normal state position; FIG. 19B showing a state in which the water tray is positioned in the open position, and the detection member is positioned in a deicing start position; and FIG. 19C showing a state in which the water tray is positioned in the open position, and the detection member is positioned in a deicing completion position.

DETAILED DESCRIPTION OF THE PREFERRED EMBODIMENTS

Next, an automatic ice maker of the present invention and its operating method will be described by way of preferred embodiments with reference to the accompanying drawings.

(First Embodiment)

Figure 1:
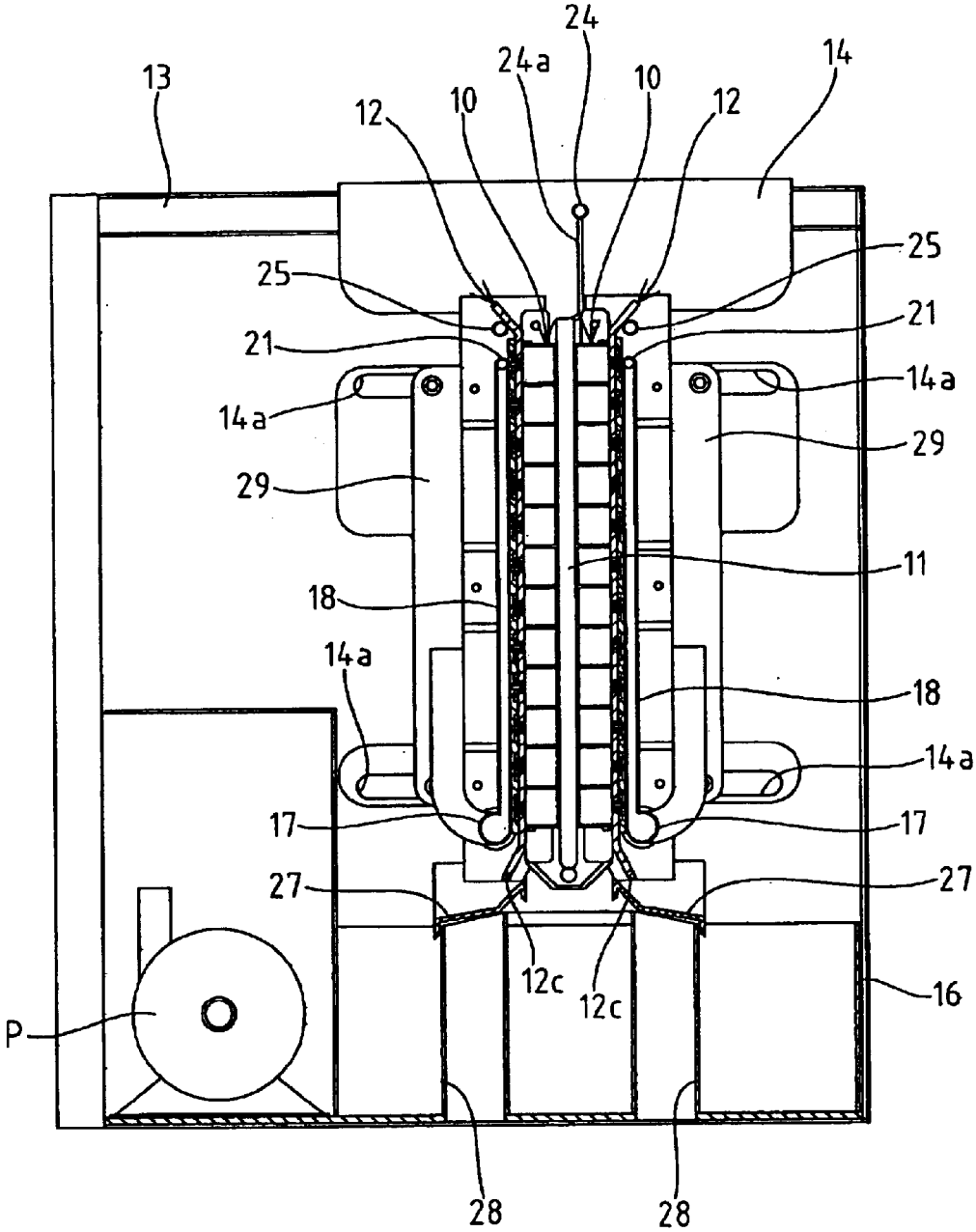
FIG. 1 is a longitudinal front view showing a schematic constitution of an automatic ice maker in an ice making state according to a first embodiment of the present invention.

FIG. 1 schematically shows a main ice making mechanism of an automatic ice maker in an ice making state according to a first embodiment of the present invention. In the drawing, the ice making mechanism for making many ice cubes (lumps of ice) of required outer diameters basically comprises a pair of ice making chambers (ice making sections) 10, 10 which each have a plurality of ice making compartments 10*a* open in a horizontal direction and which are roughly vertically arranged so that backsides thereof (sides opposite to the open sides of the ice making compartments 10*a*) can face each other, a plurality (two in the embodiment) of cooling tubes 11, 11 arranged between the backsides of the ice making chambers 10, 10, and a water tray 12 to be brought close to and apart from the front surface side (open side of the ice making compartment 10*a*) of each ice making chamber 10.

(Ice Making Chamber)

Figure 2:
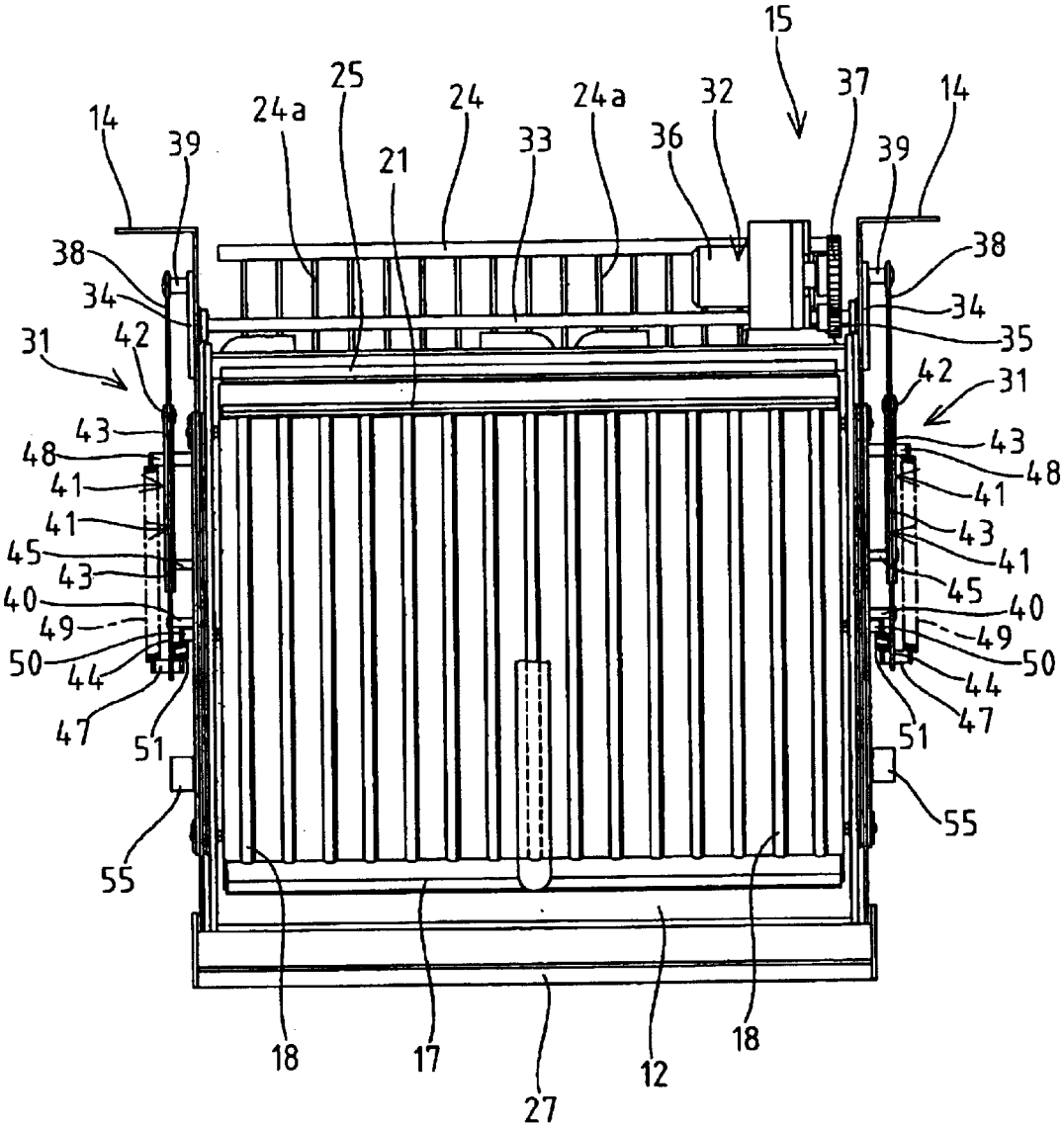
FIG. 2 is a side view showing a schematic constitution of an ice making mechanism in the automatic ice maker of the first embodiment.

A pair of ice making chamber brackets 14, 14 are arranged to be apart from each other in a back-and-forth direction on the main body frame 13 of the automatic ice maker and, as shown in FIG. 2, the ice making chambers 10, 10 are supported between the brackets 14, 14 in postures in which their width directions are aligned in the back-and-forth direction. Each ice making chamber 10 is made of a metal (e.g., copper) having good thermal conductivity to be in a rectangular box shape, and a plurality of partitions 56, 57 are arranged vertically and horizontally inside to define the plurality of ice making compartments 10*a*. Both upper and lower ends of each side wall 10*b* positioned back and forth in the width direction of the ice making chamber 10 are extended by a predetermined length, and the extended portions 10*c*, 10*c* are arranged in the corresponding ice making chamber bracket 14 through heat insulating materials (not shown), whereby the ice making chamber 10 is arranged roughly vertically.

The plurality of vertical and horizontal partitions 56 and 57 are arranged orthogonally to each other, and the ice making compartment 10*a* defined by these partitions 56, 57 is set in a cubic shape. In other words, the vertical partitions 56, 56 facing each other back and forth and the horizontal partitions 57, 57 facing each other up and down face each other in parallel. Additionally, ends of both partitions 56, 57 on front surface sides are positioned inward by a predetermined length from the front surface end of the ice making chamber 10, and set to interconnect ice cubes produced in the ice making compartments 10*a* by an ice layer formed on the front surface side.

(Cooling Tube)

Figure 3:
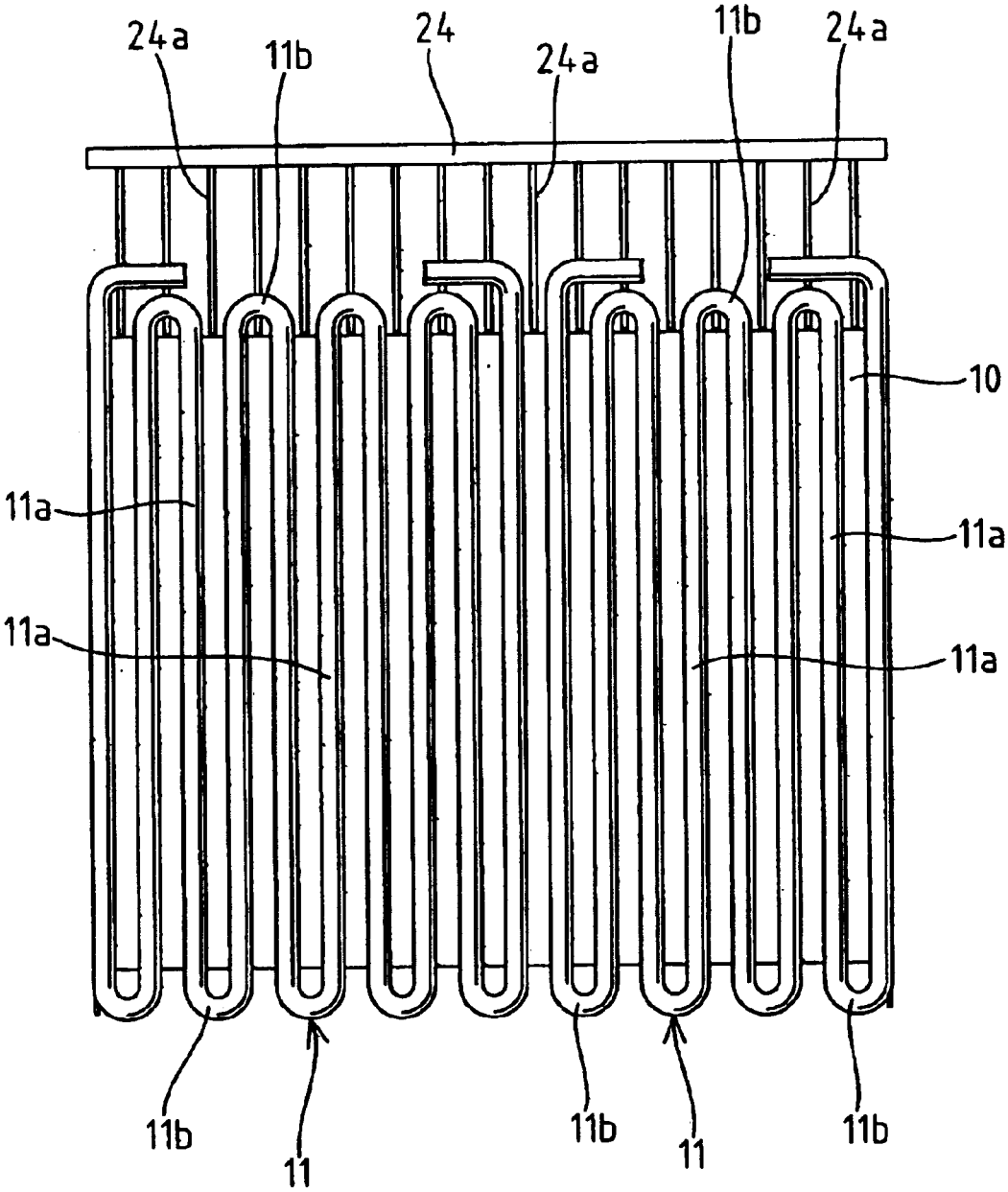
FIG. 3 is a side view showing an ice making chamber of the first embodiment.

As shown in FIG. 3, two cooling tubes 11, 11 which constitutes part of a not-shown freezer are tightly fixed between the backsides of the ice making chambers 10, 10. During an ice making operation, refrigerants are circulated through the cooling tubes 11, 11 to forcibly cool the ice making chambers 10, 10. During a deicing operation, a high-temperature gas (referred to as "hot gas", hereinafter) is circulated to heat the ice making chambers 10, 10. Each cooing tube 11 is formed in a meandering shape in which linear portions 11*a* and bend portions 11*b* bent in a U shape are repeated, and the bend portions 11*b* are arranged on the backside of the ice making chamber 10 to be positioned above and below. The cooling tubes 11, 11 are arranged in parallel in the width direction of the ice making chamber 10, and inlets of the refrigerant fed from a freezer and the hot gases are set on ends of a front or rear side of the ice making chamber 10 in the width direction. In other words, the inlet of the cooling tube 11 positioned on the front side is on a front surface side of the ice making chamber 10, and the inlet of the cooling tube 11 positioned on the rear side is on a rear surface side of the ice making chamber 10, and the refrigerant and the hot gas fed to the cooling tubes 11, 11 flow from both front and rear ends of the ice making chamber 10 toward the center in the width direction.

As shown in FIG. 3, the upper and lower bend portions 11*b*, 11*b* of each cooling tube 11 are set to be extended from the upper and lower ends of the ice making chamber 10 to the outside, and a gap is defined between each bend portion 11*b* and the ice making chamber end. The gap defined between the lower bend portion 11*b* and the ice making chamber lower end functions to cause ice making water fed into the ice making compartment 10*a* during the ice making operation and deicing water fed to the backside of the ice making chamber during the deicing operation to flow down without dwelling in the bend portion 11*b*. The gap defined between the upper bend portion 11*b* and the ice making chamber upper end functions to cause the deicing water to flow down on the entire backside of the ice making chamber 10.

(Water Tray)

Figure 6:
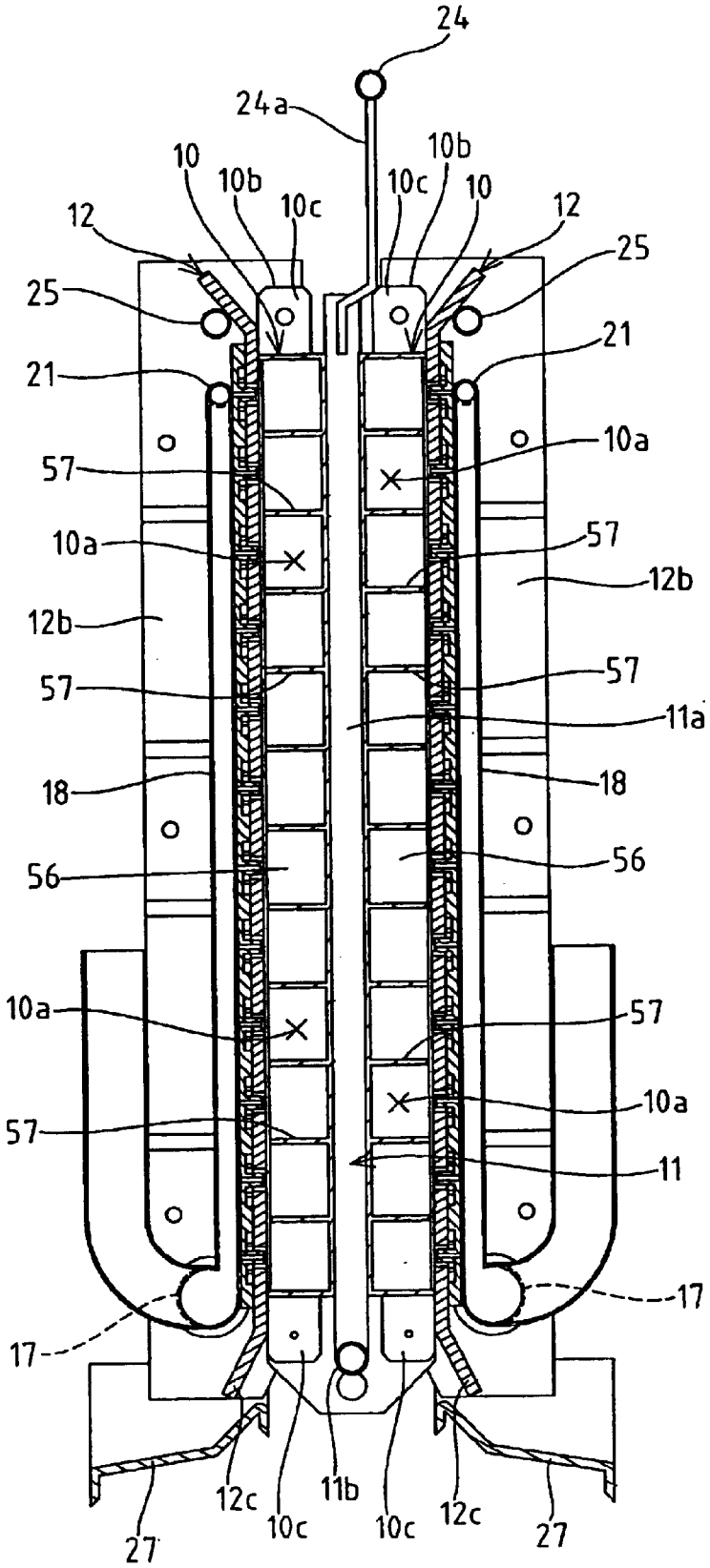
FIG. 6 is a longitudinal front view showing the water tray in a state in which it is positioned in an ice making position with respect to the ice making chamber of the first embodiment.
Figure 7:
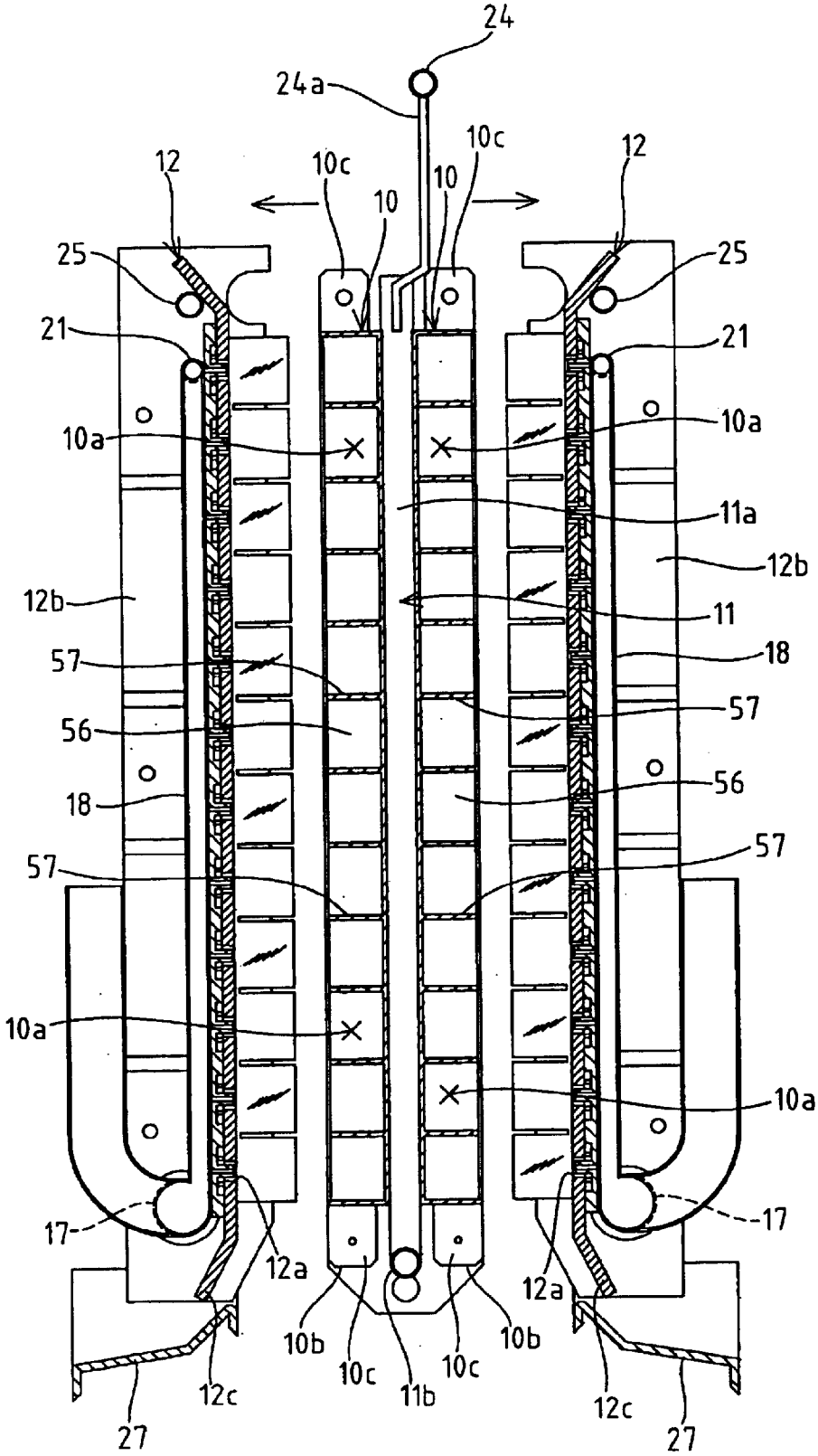
FIG. 7 is a longitudinal front view showing the water tray in a state in which it is positioned in an open position with respect to the ice making chamber of the first embodiment.

Water plates 12 supported by a later-described opening/closing device 15 to be horizontally moved in parallel face the front surface sides of the ice making chambers 10, 10. Each water tray 12 is made of a material (e.g., synthetic resin) to which ice is difficult to freeze into a flat plate shape of a size to cover all the ice making compartments 10*a* of the ice making chamber 10, and a surface (ice lump freezing surface) to close the ice making compartment 10*a* is set to be flat. The water trays 12 are moved back and forth in parallel in vertically directed postures between an ice making position (FIG. 6) near the front surface side of the ice making chamber 10 and an open position (FIG. 7) apart from the front surface side by the opening/closing device 15. As shown in FIG. 6, upper and lower ends of the water tray 12 are extended from the ice making chamber 10 to the outside, and bent to incline by predetermined angle (e.g., 30 to 45°) in a direction to be apart from the ice making chamber 10 toward the open ends thereof, whereby strength of the water tray itself is increased. A lower bent portion 12*c* functions as a guiding means for guiding unfrozen water (described later) fed to the ice making compartment 10*a* to flow down without being frozen during the ice making operation and deicing water which flows down on the backside of the water tray 12 during the deicing operation to a later-described ice making water tank 16.

A through-hole 12*a* is formed in a position of the water tray 12 corresponding to the center of each ice making compartment 10*a*. A protrusion 19 disposed in a later-described distribution tube 18 is concentrically inserted into the through-hole 12*a* to define a return hole 20 around the protrusion 19 (see FIG. 5).

As shown in FIG. 1, the ice making water tank 16 is arranged below the ice making mechanism, and the required amount of ice making water reserved in the tank is fed through a circulation pump P to the center of a feed tube 17 arranged on a backside lower part of each water tray 12 to be extended in the width direction. A connection portion between the ice making water tank 16 and the circulation pump P is set on the lowermost part of the tank 16, and the bottom of the tank is set to incline downward to the connection portion, whereby the amount of ice making water left unused in the tank is reduced.

Figure 4:
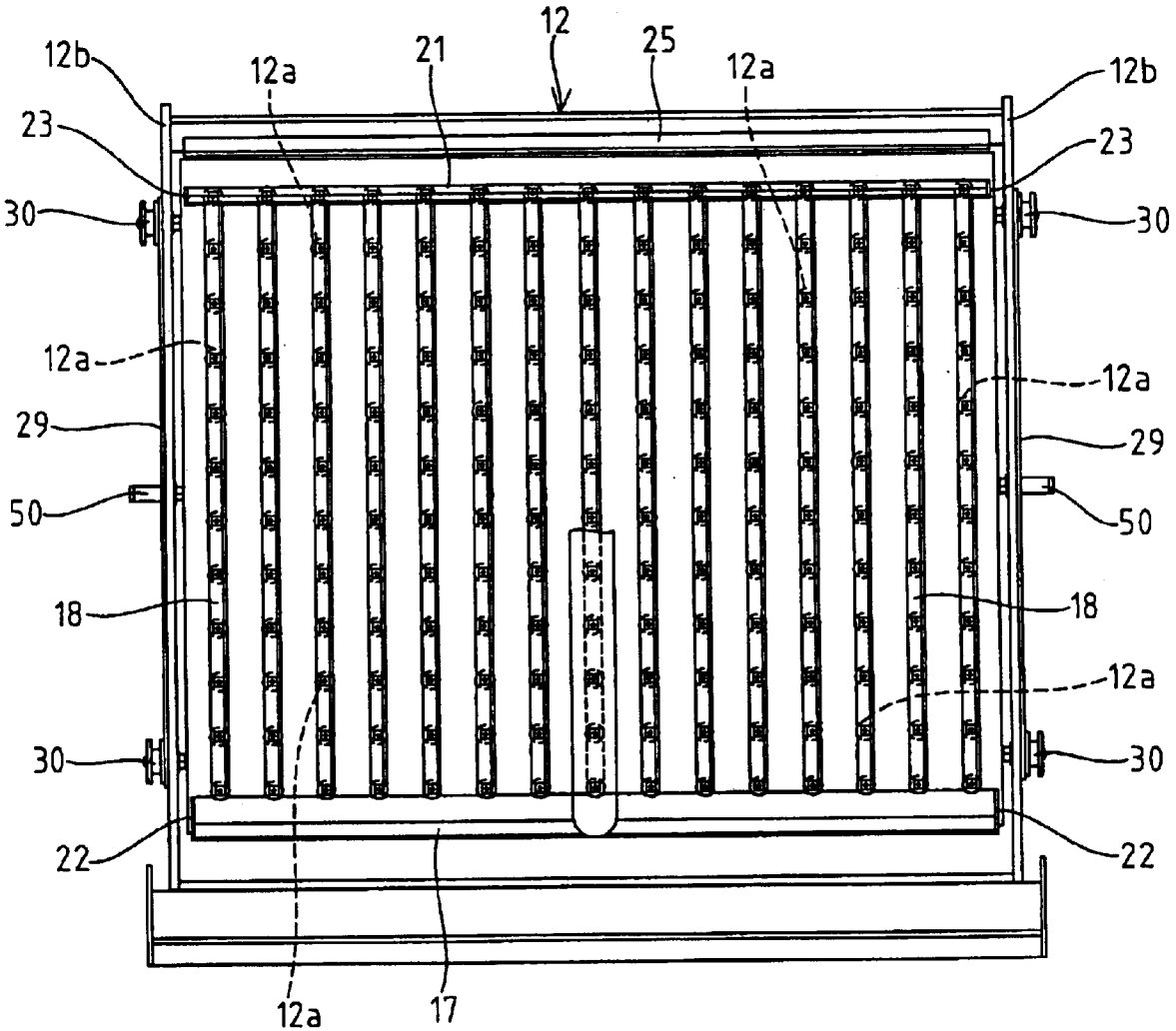
FIG. 4 is a side view showing a water tray of the first embodiment.
Figure 5:
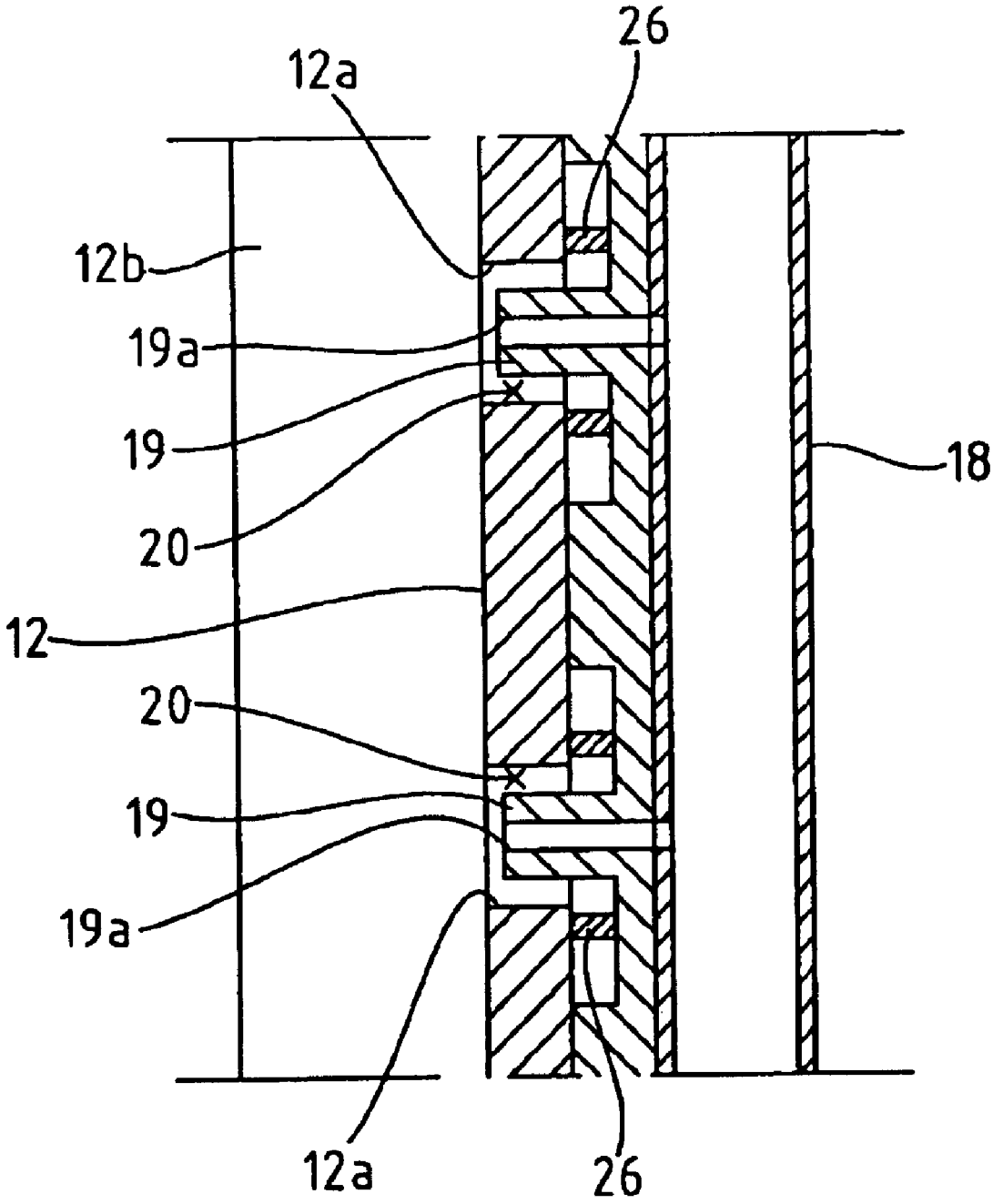
FIG. 5 is a main portion sectional view of the water tray of the first embodiment.

As shown in FIG. 4, a plurality of distribution tubes 18 are led out in parallel from the feed tube 17, and each distribution tube 18 is extended upward along a group of vertically arranged through-holes of the water tray 12. As shown in FIG. 5, a protrusion 19 of a diameter smaller than that of the through-hole 12*a* is disposed in a position of the distribution tube 18 corresponding to the through-hole 12*a*, and the protrusion 19 is concentrically inserted into the through-hole 12*a*. A spout hole 19*a* of a small diameter (e.g., 1.4 mm) is bored in the protrusion 19. The ice making water fed under pressure from the ice making water tank 16 through the circulation pump P to the distribution tube 18 can be sprayed through the spout hole 19*a* to the corresponding ice making compartment 10*a*. That is, according to the embodiment, the water tray 12, the feed tube 17 and the distribution tube 18 constitute an ice making water feeding means, and the feeding means is adapted to and be integrally moved close to/apart from the ice making chamber 10 in parallel.

A return hole 20 is defined around the protrusion 19 concentrically inserted into the through-hole 12*a* of the water tray 12 and, when a later-described ice making operation is carried out, ice making water which has not been frozen in the ice making chamber 10 (referred to as "unfrozen water", hereinafter) can be returned through this return hole 20 to the ice making water tank 16. As shown in FIG. 5, the tip of the protrusion 19 is set not to protrude from the surface (surface opposite the ice making chamber 10) of the water tray 12, and adapted to prevent the ice cubes frozen to the water tray 12 from being caught when they are removed to fall.

The upper ends of all the distribution tubes 18 are connected to a connection tube 21, and constituted together with the feed tube 17 to distribute the ice making water endlessly. Both ends of the feed tube 17 and the connection tube 21 in a lengthwise direction are closed by lids 22, 23 to be reopened (see FIG. 4), and the insides of the tubes can be cleaned by removing the lids 22, 23.

In an upper position between the ice making chambers 10, 10, a first deicing water sprinkling tube 24 connected through a water feed tube (not shown) to an external water supply system is extended in the width direction. In the water sprinkling tube 24, a branch tube 24*a* is connected to each of the positions corresponding to the group of ice making compartments aligned in a vertical direction. Tap water at a normal temperature (deicing water) is fed to the first deicing water sprinkling tube 24 by opening a first feed valve WV1 (see FIG. 12) inserted into the feed tube. This deicing water flows down on the backsides of the ice making chambers 10, 10 through the branch tubes 24*a* to be fed to the ice making water tank 16, so that the deicing water is used as ice making water for the next ice making operation. Since the bend portions 11*b* of the cooling tubes 11, 11 are extended outward from the upper and lower ends of the ice making chambers 10, 10, the flowing-down of the deicing water is smooth.

Side plates 12*b*, 12*b* are arranged on both front and rear sides of each water tray 12. On the upper part of the rear side of the water tray 12 between the side plates 12*b*, 12*b*, a second deicing water sprinkling tube 25 as a deicing means connected through a feed tube (not shown) to the external water supply system is arranged in parallel with the connection tube 21 (see FIG. 4). Tap water at a normal temperature (deicing water) is fed to the second deicing water sprinkling tube 25 by opening a second feed valve WV2 (see FIG. 12) inserted into the feed tube. A plurality of sprinkling holes (not shown) are bored in the second deicing water sprinkling tube 25. The deicing water fed to the second deicing sprinkling tube 25 flows down on the backside of the water tray 12 through the sprinkling hole to be fed to the ice making water tank 16, so that this water is also used as ice making water for the next ice making operation. As shown in FIG. 5, a dam member 26 is arranged on the backside of the water tray 12 to surround each through-hole 12*a*, and adapted to prevent melting of the ice cubes caused by the flowing-out of the deicing water flowing down on the back side of the water tray through the through-hole 12*a* to the front surface side. The dam member 26 permits flowing-out of ice making water through the return hole 20 to the backside.

As shown in FIGS. 4 and 6, below the bent portion 12*c* of the water tray 12, a trough member 27 is arranged as a cover means to be integrally moved with the water tray 12, and adapted to recover the ice making water or the deicing water which flows down on the front or back side of the water tray 12 to be guided by the bent portion 12*c* in the trough member 27, and to guide it to the ice making water tank 16.

An ice passage port 28 is formed in the ice making water tank 16 facing below the ice cubes frozen on the front surface side of the water tray 12 in a state in which the water tray 12 has been moved to the open position by the opening/closing device 15. The group of ice cubes which is peeled off from the water tray 12 to fall by the deicing operation is discharged through the ice passage port 28 to a not-shown ice storage chamber. In the ice making position of the water tray 12, the ice passage port 28 is covered with the trough member 27 to be closed (see FIG. 1), whereby flowing of the ice making water through the ice passage port 28 into the ice storage chamber is prevented. The end of the trough member 27 directed to the ice making chamber 10 is set not to protrude from the surface of the water tray 12 to the ice making chamber side, so that smooth falling of the group of ice cubes peeled off from the water tray 12 can be achieved.

(Opening/Closing Device)

Figure 8:
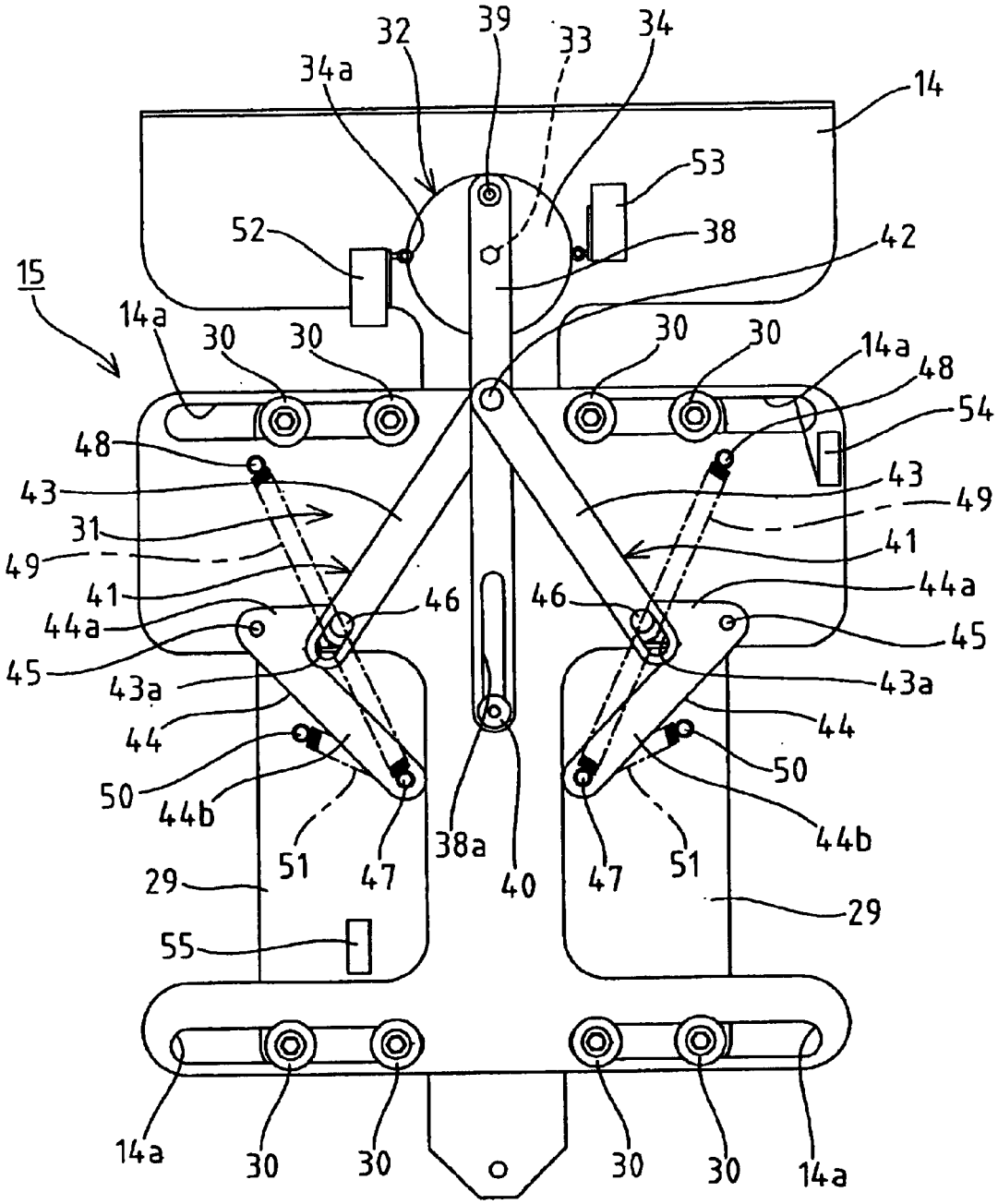
FIG. 8 is a front view showing an opening/closing device of the first embodiment in a state in which the water tray is positioned in the ice making position.

Water plate brackets 29, 29 are arranged on both front and rear side plates 12*b*, 12*b* of each water tray 12 (see FIG. 4). As shown in FIG. 8, pairs of guide rollers 30, 30 apart from each other in opposite directions (direction of approaching/moving away from the ice making chamber 10) are rotatably arranged on both upper and lower ends of the brackets 29. In both of the ice making chamber brackets 14, 14, pairs of elongated holes 14*a*, 14*a* extended in opposite directions are formed to be vertically apart from each other in parallel in positions corresponding to the water trays 12. The upper and lower guide rollers 30, 30 corresponding to the upper and lower elongated holes 14*a*, 14*a* are arranged to be movable. In other words, the water trays 12 are adapted to be movable in parallel in opposite directions along the upper and lower elongated holes 14*a*, 14*a*.

The opening/closing device (opening/closing means) 15 of the water trays 12, 12 comprises a pair of linking mechanisms 31, 31 arranged in both of the ice making chamber brackets 14, 14, and an actuator mechanism 32 for actuating the linking mechanisms 31, 31. The linking mechanisms 31, 31 are actuated by the actuator mechanism 32 to move the two water trays 12, 12 between the ice making position and the open position.

(Actuator Mechanism)

As shown in FIG. 2, the actuator mechanism 32 comprises a rotary shaft 33 rotatably bridged between the upper ends of the ice making chamber brackets 14, 14. A cam 34 is arranged to be integrally rotated at the end of the rotary shaft 33 protruded outward from each ice making chamber bracket 14. A driven gear 35 is arranged to be integrally rotated on the inside of the front of the rotary shaft 33 near the ice making chamber bracket 14. Further, a driving gear 37 is arranged to be integrally rotated on the output shaft of a motor 36 disposed on the main body frame 13, and the driving gear 37 is engaged with the driven gear 35. In other words, the motor 36 is driven to make revolutions in a predetermined direction to rotate the cams 34, 34 in a reverse direction (clockwise direction in FIG. 8 according to the embodiment) together with the rotary shaft 33.

(Linking Mechanism)

Actuator levers 38, 38 which constitute the corresponding linking mechanisms 31, 31 are connected to both cams 34, 34. The actuator levers 38, 38 are operated by rotating the cams 34, 34. As the linking mechanisms 31, 31 are symmetrical in constitution, only the constitution of the linking mechanism 31 arranged on the front side is described, and similar members of the linking mechanism 31 on the rear side are denoted by similar reference numerals.

Figure 10:
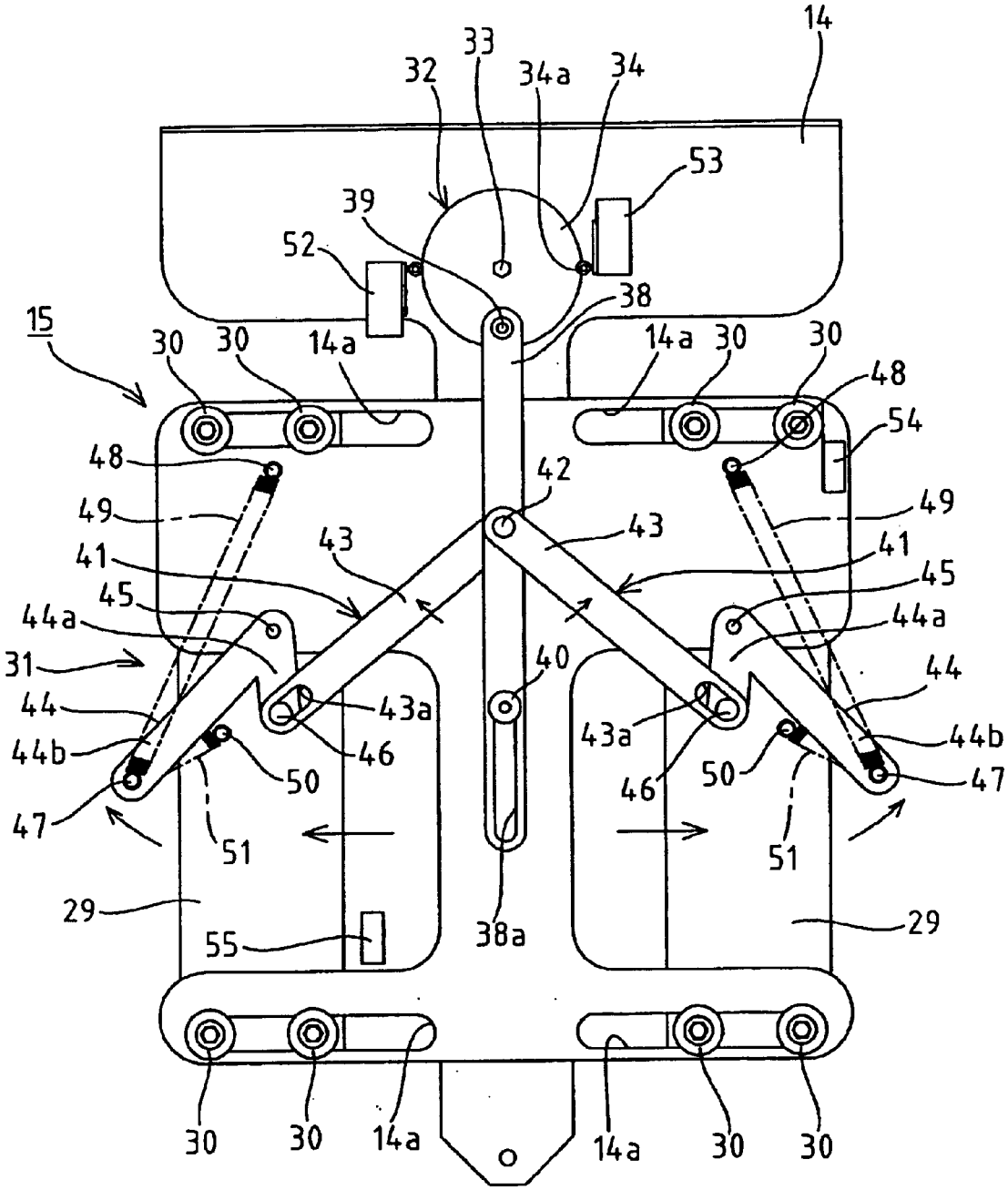
FIG. 10 is a front view showing the opening/closing device of the first embodiment in a state in which the water tray is moved to the open position.
Figure 11:
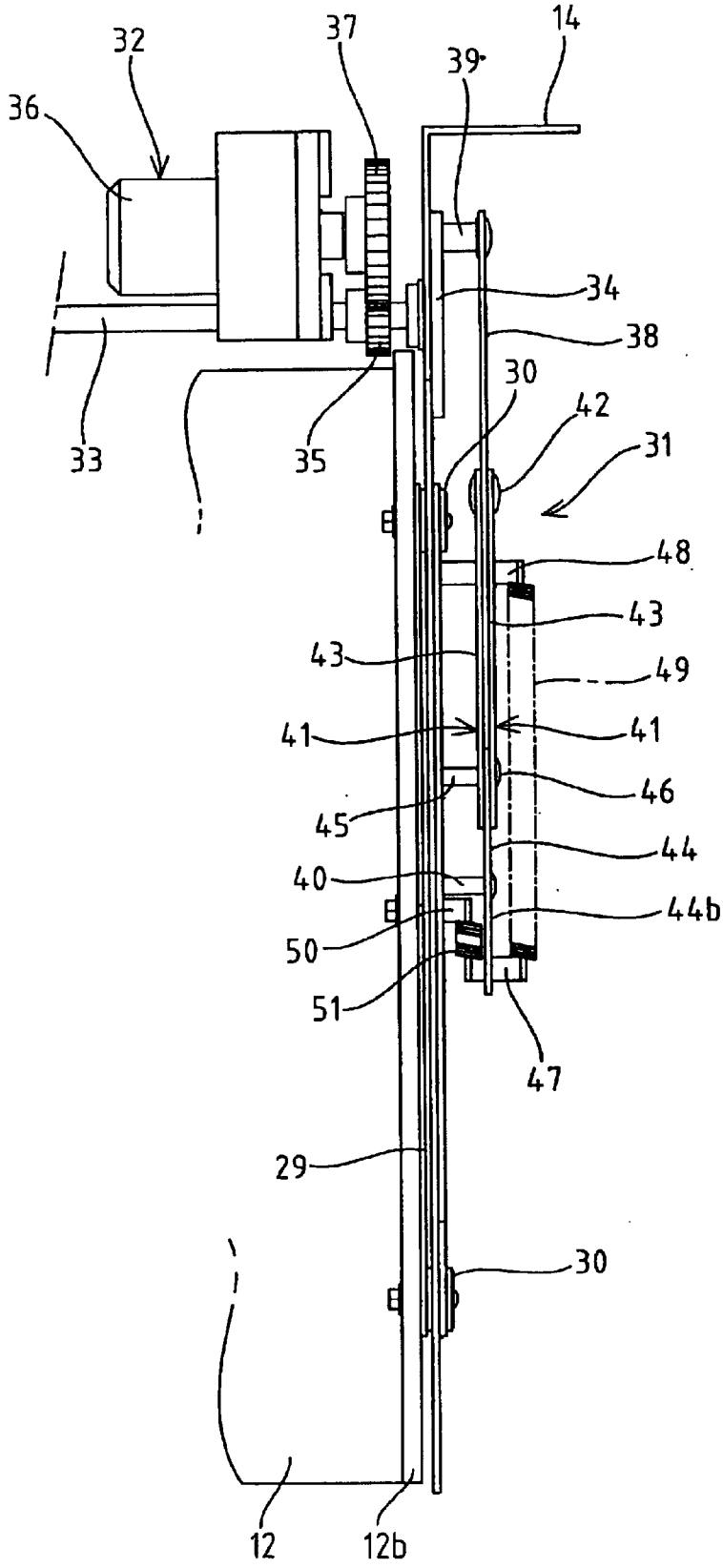
FIG. 11 is a side view showing one linking mechanism in the opening/closing device of the first embodiment.

That is, as shown in FIG. 11, the actuator lever 38 droops by a predetermined length, one end of which is pivotally supported rotatably through a first supporting point pin 39 on a part made eccentric from the rotational center of the cam 34. A elongated hole 38*a* is formed to be extended in a lengthwise direction (up-and-down direction) at the lower end of the lever 38. A guide pin 40 is disposed to protrude in a position apart by a predetermined length directly below the rotational center of the cam 34 in the ice making chamber bracket 14. The guide pin 40 is inserted slidably into the elongated hole 38*a* of the actuator lever 38. In other words, when the cam 34 is rotated, the actuator lever 38 is moved up and down while the elongated hole 38*a* is guided by the guide pin 40 (see FIGS. 8, 9, 10).

In the actuator lever 38, lever sets 41, 41 are continuously disposed to move the left and right water trays 12, 12.

However, as they are symmetrical in constitution across the lever 38, only the constitution of the lever set 41 arranged on the right-hand side of FIG. 8 is described, and similar members of the lever set at the left-hand side are denoted by similar reference numerals. The description below is made in a state in which the water tray 12 has been positioned in the ice making position.

(Lever Set)

A second supporting point pin 42 is disposed to protrude back and forth in a roughly middle position of the actuator lever 38 in the longitudinal direction, and one end of a intermediate lever 43 for the right-hand side is pivotally supported rotatably on an end of its front side. One end of the intermediate lever 43 for the left-hand side is pivotally supported rotatably on an end of the second supporting point pin 42 protruded from the actuator lever to the rear side. In a right-hand position from the actuator lever 38 in the ice making chamber bracket 14, an arm 44 for the right-hand side bent in a roughly L shape is pivotally supported rotatably through a third supporting point pin 45 on the bent portion. A first spindle 46 disposed to protrude on one first arm portion 44*a* of the arm 44 extended from the pivotally supporting portion toward the actuator lever 38 is inserted slidably into an elongated hole 43*a* formed in the other end of the intermediate lever 43 apart from the pivotally supporting point. Further, a second spindle 47 is disposed to protrude on a second arm portion 44*b* of the arm 44 extended obliquely downward from the pivotally supporting portion toward the actuator lever 38 below the first arm portion 44*a*.

A first spring shaft 48 is arranged in a position roughly directly above the third supporting point pin 45 in the ice making chamber bracket 14, and a first tension spring 49, one end of which is hooked by the spring shaft 48 is hooked with the other end by the second spindle 47 of the arm 44. Additionally, a second spring shaft 50 is arranged in a position below the position of the arranged third supporting point pin 45 and made eccentric to the actuator lever side with respect to the supporting point pin 45 in the water tray bracket 29, and the other end of a second tension spring 51 as an elastic member one end of which is hooked by the spring shaft 50 is hooked by the second spindle 47 of the arm 44. That is, as shown in FIG. 8, with the water tray 12 positioned in the ice making position, the lever set 41 of the right-hand side is set in such a manner that the second spindle 47 of the second arm portion 44*b* of the arm 44 arrives at the left-hand side (closing side close to the actuator lever 38) of the bottom dead point directly below the third supporting point pin 45, and the first tension spring 49 urges the arm 44 around the third supporting point pin 45 clockwise (counterclockwise in the case of the lever set 41 of the left-hand side) at this time, whereby tension of the second tension spring 51 bridged hung between the second spring shaft 50 and the second spindle 47 is applied in a direction for moving the water tray 12 close to the ice making chamber 10.

When the second spindle 47 of the second arm portion 44*b* of the arm 44 arrives at the right-hand side (open side to be apart from the actuator lever 38) of the bottom dead point directly below the third supporting point pin 45 during the later-described deicing operation (see FIG. 9), the first tension spring 49 urges the arm 44 around the third supporting point pin 45 counterclockwise (clockwise in the case of the lever set 41 of the left-hand side), whereby tension of the second tension spring 51 tensioned between the second spring shaft 50 and the second spindle 47 is applied in a direction for moving the water tray 12 away from the ice making chamber 10.

(Limit Switch)

A concave portion 34*a* is formed around the aforementioned one cam 34, and two limit switches 52, 53 which can detect the concave portion 34*a* are arranged in the corresponding ice making chamber bracket 14. The first limit switch 52 positioned on the left-hand side of FIG. 8 detects the concave portion 34*a* when the first supporting point pin 39 arrives at the top dead point directly above the rotary shaft 33, and functions to control and stop the motor 36 at this time. In this state, the water tray 12 is set to face the ice making position. The second limit switch 53 positioned on the right-hand side detects the concave portion 34*a* when the second spindle 47 of the arm 44 rotated by the actuator lever 38 and the intermediate lever 43 arrives at a position to face the open side with respect to the bottom dead point (see FIG. 9), and functions to control and stop the motor 36 at this time.

(Ice Making Completion Thermostat)

Figure 12:
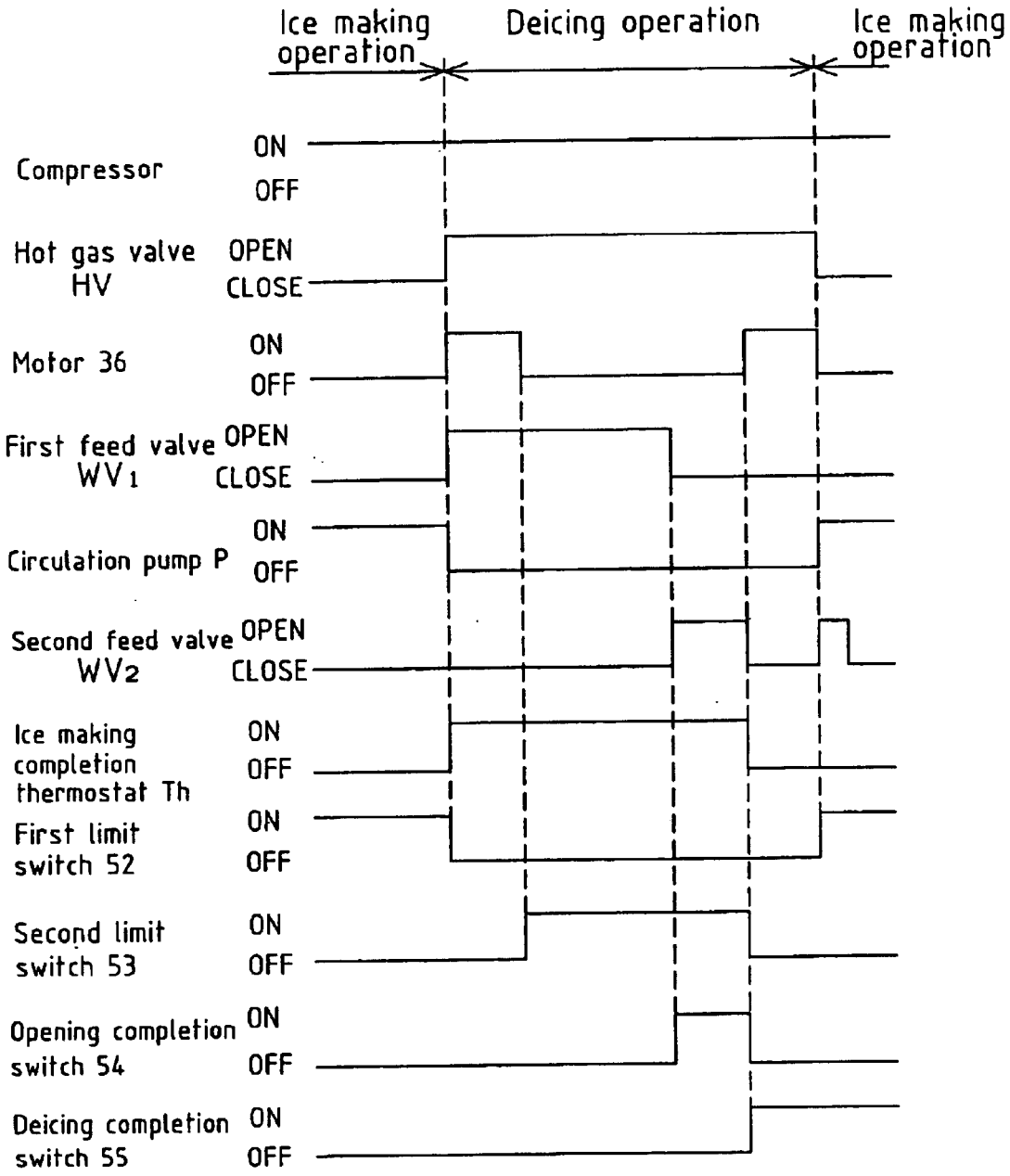
FIG. 12 is a flowchart of an ice making-deicing operation of the automatic ice maker of the first embodiment.

An ice making completion thermostat Th (see FIG. 12) as ice making completion detection means is arranged in the aforementioned one ice making chamber 10. When the thermostat Th detects a reduction of an ice making chamber temperature to an ice making completion temperature caused by formation of roughly complete ice cubes in the ice making chamber 10, the operation completes the ice making operation to transfer to a deicing operation. That is, as shown in FIG. 12, after the circulation pump P has been stopped, a hot gas valve HV of the freezer is opened to feed a hot gas to the two cooling tubes 11, 11 and to rotate the motor 36, and further the first feed valve WV1 is opened to start feeding of deicing water to the backsides of both ice making chambers 10, 10. The hot gas valve HV is closed when the first limit switch 52 detects the concave portion 34*a* after completion of the deicing operation.

(Water Plate Opening Completion Switch, Deicing Completion Switch)

An opening completion switch 54 is arranged in the ice making chamber bracket 14 to detect a movement of one water tray 12 (right-hand side in the embodiment) to the open position. When the switch 54 detects open completion of the water tray 12, the first feed valve WV1 is closed to stop feeding the deicing water to the backsides of the ice making chambers 10, 10, and the second feed valve WV2 is opened to start feeding of the deicing water to the backside of the water tray. Additionally, a deicing completion switch 55 such as a photoelectric sensor is arranged in the ice making chamber bracket 14 to detect presence of ice cubes on the front surface side of the water tray 12 in the state of the water tray 12 brought at the open position. When the switch 55 detects peeling-off and falling of the ice cubes from the water tray 12, the second feed valve WV2 is set to be closed. According to the embodiment, peeling-off and falling of the ice lumps from the water tray 12 of the left-hand side in FIG. 8 are adapted to be detected by the deicing completion switch 55.

Moreover, according to the embodiment, after the operation transfers from the deicing operation to the ice making operation and the water tray 12 is positioned in the ice making position, the second feed valve WV2 is opened to additionally feed deicing water (ice making water) to the ice making water tank 16 for a predetermined period of time (e.g., 15 sec.) set by a not-shown timer.

(Operation of First Embodiment)

Next, an operation of the automatic ice maker of the first embodiment will be described by referring to a timing chart of FIG. 12. When an ice making operation is carried out, as shown in FIG. 6, the water trays 12, 12 face the ice making positions near the front surface sides of the ice making chambers 10, 10 to close the ice making compartments 10*a*. At this time, as shown in FIG. 8, the first supporting point pin 39 of the actuator lever 38 of each linking mechanism 31 in the opening/closing device 15 is positioned at the top dead point, and the second spindle 47 of the arm 44 in each lever set 41 is positioned on the closing side with respect to the bottom dead point, so that each water tray 12 is urged toward the ice making position by tension of the second tension spring 51.

In the aforementioned state, by operating (compressor ON) the freezer, a refrigerant is circulated and fed to the two cooling tubes 11, 11 arranged on the backsides of the ice making chambers 10, 10 to cool the ice making chambers 10, 10. In this case, the plurality of cooling tubes 11, 11 enable shortening of a length of each cooling tube 11, whereby line resistance is reduced to improve cooling capability. By operating the circulation pump P, the ice making water from the ice making water tank 16 is fed under pressure through each distribution tube 18, and spayed and fed through each spout hole 19*a* of the distribution tube 18 into each ice making compartment 10*a* of the ice making chamber 10.

The sprayed ice making water is brought into contact with an inner wall surface of the ice making compartment 10*a* to be cooled. The unfrozen water which flows out from the opening without being frozen in the ice making compartment 10*a* flows out of each return hole 20 of the water tray 12 to the backside of the water tray 12 to go down, and then returns through the bent portion 12*c* and the trough member 27 to the ice making water tank 16 to be circulated again. Since the ice passage port 28 is closed by the corresponding trough member 27 during the ice making operation (see FIG. 1), the ice making water flowing down on the water tray backside is prevented from entering the ice storage from the ice passage port 28. In other words, refreezing caused by sticking of the ice making water to the ice cubes stored in the ice storage is suppressed. While the circulation of the ice making water is repeated, part of the ice making water is frozen to start forming an ice layer in the ice making compartment 10*a*, and an ice cube corresponding to the internal shape of the ice making compartment 10*a* is finally produced. As described above, since the ends of the font surface sides of the partitions 56, 57 defining the ice making compartments 10*a* are positioned inside by a predetermined length with respect to the surface end of the ice making chamber 10, the ice cubes produced in the ice making compartments 10*a* are interconnected by the ice layers formed on the front surface sides, and frozen to be stuck to the surface of the water tray.

When the ice making completion thermostat Th detects that the production of the ice cubes has been completed and the temperature of the ice making chamber 10 has reached the ice making completion temperature, the circulation pump P is stopped to terminate the circulated feeding of the ice making water. The hot gas valve HV is opened to feed a hot gas to the cooling tubes 11, 11, and the ice making chambers 10, 10 are warmed to start melting frozen surfaces between the inner wall surfaces of the ice making compartments 10*a* and the ice cubes. At this time, since inlets of the hot gas of the cooling tubes 11 are set on both ends of the ice making chamber 10 in the width direction, all the ice cubes in the ice making chamber 10 are evenly melted to be prevented from becoming partially thin and irregular. Additionally, the first feed valve WV1 is opened to start feeding water to the first deicing water sprinkling tube 24 connected to the external water supply system. The deicing water (tap water at a normal temperature) fed to the first deicing water sprinkling tube 24 is sprinkled through the branch tubes 24*a* to the backsides of the ice making chambers 10, 10, whereby the ice making chambers 10, 10 are heated to reduce freezing between the ice making compartments 10*a* and the ice cubes. In this case, as the lower bend portions 11*b* of the cooling tubes 11, 11 are extended outward from the lower ends of the ice making chambers 10, 10, the deicing water smoothly flows down to be recovered in the ice making water tank 16.

Figure 9:
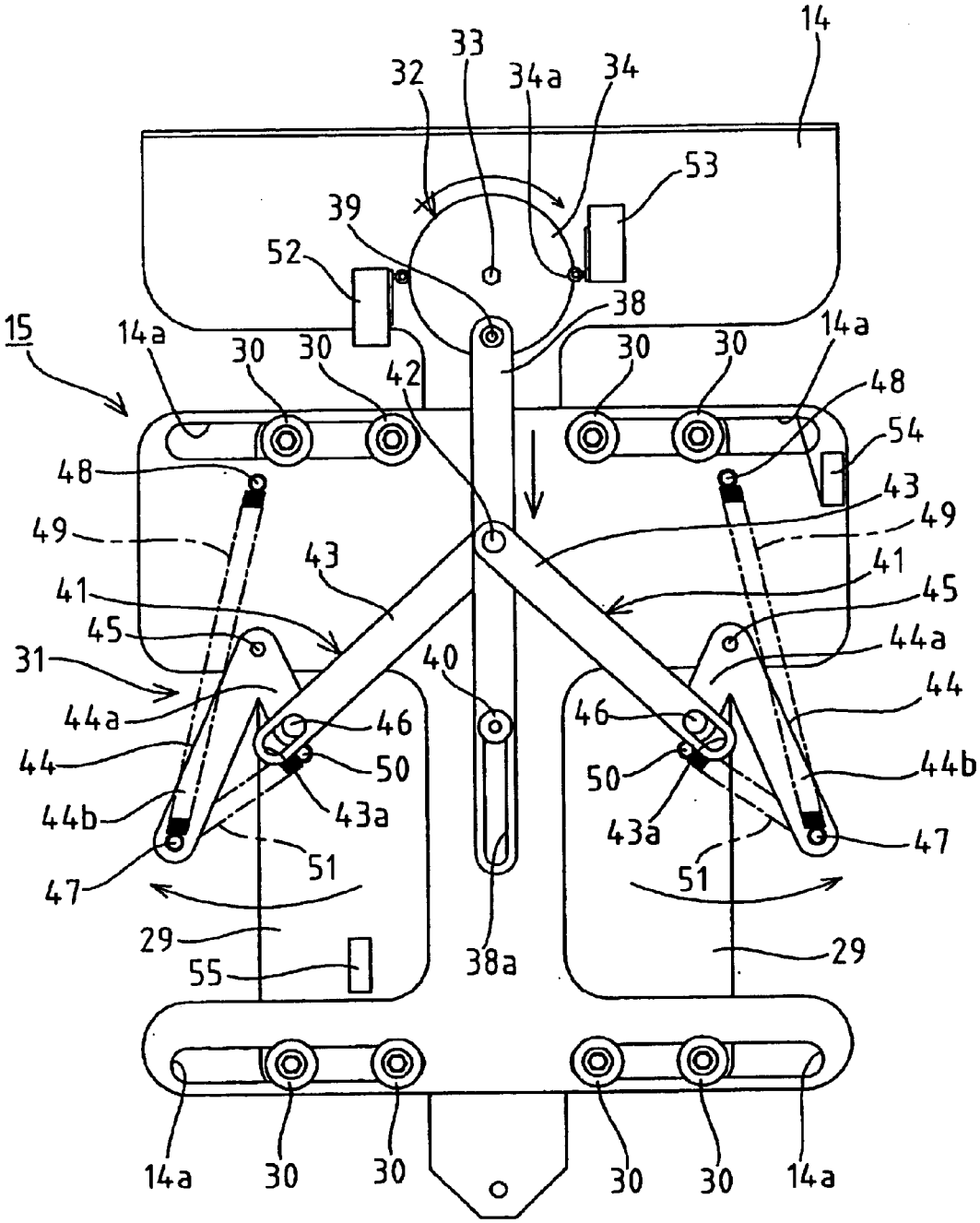
FIG. 9 is a front view showing the opening/closing device of the first embodiment in a state in which the water tray of the ice making position is urged in a direction to be apart from the ice making chamber.

By the aforementioned detection of the ice making completion, the motor 36 of the opening/closing device 15 is driven to make revolutions, and clockwise rotation of the cams 34, 34 shown in FIG. 8 is started, whereby the pair of linking mechanisms 31, 31 are actuated. That is, in each linking mechanism 31, the actuator lever 38 pivotally supported on the cam 34 through the first supporting point pin 39 is guided by the guide pin 40 engaged with the elongated hole 38*a* to move downward. By the downward movement of the actuator lever 38, the intermediate levers 43, 44 are depressed and, in the arm 44 engaged with the upper end of the elongated hole 43*a* of the intermediate lever 43 through the first spindle 46, the second arm portion 44*b* is rotated around the third supporting point pin 45 in a direction to be apart from the actuator lever 38. Then, when the second limit switch 53 detects the concave portion 34*a* of the cam 34, the motor 36 is temporarily stopped. At this time, since the second spindle 47 of the arm 44 is positioned on the open side with respect to the bottom dead point as shown in FIG. 9, tension of the second tension spring 51 is applied in a direction for moving the corresponding water tray 12 apart from the ice making chamber 10.

When by the feeding of the hot gas to the cooling tubes 11, 11 and the feeding of the deicing water to the backside of the ice making chamber, the ice making chamber 10 is warmed to reduce the sticking of the ice cubes to the ice making compartments 10*a*, the ice cubes are separated from the ice making chamber 10 to be removed from the ice making compartments 10*a* while the ice cubes are frozen on the water tray 12 urged in the direction to be apart from the ice making chamber 10 by the tension of the first and second tension springs 49, 51, and the water tray 12 reaches the open position as shown in FIG. 10. In other words, since the ice cubes are removed after the sticking between the ice making compartments 10*a* and the ice cubes is reduced, the ice making chamber 10 and its supporting mechanism portion can be set low in strength to lower the manufacturing costs. Moreover, it will be less noisy when the ice cubes are removed from the ice making compartments 10*a*.

The foregoing constitution of assisting the deicing by the tension of the tension springs 49, 51 enables shortening of the deicing time. It is not necessary to detect and control the possibility of separating the ice cubes from the ice making chamber 10 based on temperature, by a timer or the like, and thus the control system can be simplified. Further, durability of the opening/closing device 15 can be improved because a load applied to the linking mechanism 31 can be reduced by the changes in elongation of the tension springs 49, 51. The deicing of the ice making chamber 10 is carried out by using the hot gas and the deicing water, and thus the deicing time can be shortened.

When the opening completion switch 54 detects the arrival of the water tray 12 at the open position, the first feed valve WV1 is closed to stop the feeding of the deicing water to the backsides of the ice making chambers 10, 10. In this state, the second feed valve WV2 is opened to start feeding water to the second deicing water sprinkling tube 25 connected to the external water supply system. The deicing water (tap water at a normal temperature) fed to the second deicing water sprinkling tube 25 is sprinkled through the spout hole to the backside of the water tray 12, whereby the water tray 12 is heated to reduce the freezing with the ice cubes frozen on its front surface side. Flowing-out of the deicing water which flows down on the backside of the water tray through the through-hole 12*a* to the front surface side is prohibited by the dam member 26, and thus melting of the ice cubes by the deicing water is prevented. The deicing water which flows down on the backside of the water tray is guided through the bent portion 12*c* and the trough member 27 to be prevented from entering the ice storage through the ice passage port 28.

After removing of the freezing between the water tray 12 and the ice cubes to a certain extent, the ice cubes fall by their own weight to be stored through the ice passage port 28 in the ice storage. Since the water tray 12 is heated by the deicing water to reduce the sticking between the water tray 12 and the ice cubes, and the water tray itself is made of a material to which ice is difficult to freeze as described above, the ice cubes are peeled off to fall from the water tray 12 within a short period of time. Since the surface of the water tray 12 to which the ice cubes are frozen is flat, only a small amount of heat is necessary to peel off the ice cubes, and deicing is enabled only by the deicing water fed through the second deicing water sprinkling tube 25 to the backside of the water tray as in the case of the embodiment. Moreover, since the water tray 12 is longitudinally oriented, the deicing water fed to its vertical backside uniformly flows down to heat the entire backside evenly, and thus the deicing is further facilitated. When the deicing completion switch 55 detects the peeing-off and falling of the ice cubes from the water tray 12, the second feed valve WV2 is closed, and the rotation of the motor 36 is resumed. The tip of the protrusion 19 inserted into the through-hole 12*a* of the water tray 12 is not protruded from the surface of the water tray 12 as shown in FIG. 5. Thus, the deicing and the falling of the ice cubes from the water tray 12 are not inhibited, and the falling is smooth. Similarly, since the end of the trough member 27 is not protruded from the surface of the water tray 12, the falling of the ice, cubes is never inhibited.

As described above, according to the embodiment, the water trays 12 for opening/closing the ice making compartments 10*a* are horizontally moved in parallel with respect to the longitudinally oriented ice making chamber 10 while the ice cubes are frozen on the water trays 12. Thus, the displacement of the water tray 12 only needs to be set slightly larger than the lateral size of the ice cubes. Accordingly, the ice making mechanism itself can be downsized, and a large amount of ice can be produced in a small installation space. Besides, because of the opposing arrangement of the two ice making chambers 10, 10 across the cooling tube 11, more ice cubes can be produced efficiently in a small space. The parallel movement of the water trays 12 enables the ice making compartment 10 to be formed in a cubic shape, and thus it is possible to produce ice cubes of uniform shapes. Moreover, since the ice cubes frozen on the water tray 12 are dropped right below, the opening size of the ice passage port 28 can be set small, whereby the ice making water tank 16 can be downsized.

The motor 36 is driven to make revolutions to start rotating the cams 34, 34 clockwise in FIG. 10. Accordingly, the actuator lever 38 pivotally supported on the cam 34 through the first supporting point pin 39 is guided by the guide pin 40 to move upward. By the upward movement of the actuator lever 38, the intermediate levers 43, 43 are pulled upward and, in the arm 44 engaged with the lower end edge of the long hole 43*a* of the intermediate lever 43 through the first spindle 46, the second arm portion 44*b* is rotated around the third supporting point pin 45 in a direction of approaching the actuator lever 38. Then, when the first limit switch 52 detects the concave portion 34*a* of the cam 34, the motor 36 is stopped. At this time, since the second spindle 47 of the arm 44 is positioned on the closing side with respect to the bottom dead point, tension of the second tension spring 51 is applied in a direction of moving the water ray 12 to approach the ice making chamber 10, and the water tray 12 moves from the open position to be held in the ice making position for closing the opening of the ice making chamber 10. As described above, the water tray 12 is moved through the tension springs 49, 51. Thus, even if an ice cube or the like is caught between the water tray 12 and the ice making chamber 10, elongation of the tension springs 49, 51 are changed to prevent application of a large load on the opening/closing device 15, whereby failures of the device 15 can be prevented. Additionally, mounting of the opening/closing device 15 is easy because dimension accuracy, mounting errors etc. of its components can be absorbed by the tension springs 49, 51.

The hot gas valve HV is closed to circulate a refrigerant to the two cooling tubes 11, 11, and the circulation pump P is operated to start circulated feeding of ice making water to the ice making compartments 10*a*, whereby the ice making operation is resumed. When the ice making operation is resumed, the second feed valve WV2 is opened for several seconds set by the timer to additionally feed tap water which flows down on the backside of the water tray 12 to the ice making water tank 16.

In the automatic ice maker of the embodiment, when the deicing operation is carried out, a plurality of ice cubes produced in the ice making compartments 10*a* of the ice making chamber 10 are interconnected by the ice layers formed between partitions and the water tray 12, and these ice cubes are peeled off to fall in the frozen state. Thus, scattered falling of the ice cubes is prevented. In other words, if the ice cubes fall in a scattered manner, deicing completion detection is carried out by the deicing completion switch 55 in a state in which the ice cubes are left and stuck to part of the water tray 12, and the ice cubes are prevented from being caught between the ice making chamber 10 and the water tray 12.

(Modification of First Embodiment)

The number of cooling tubes arranged on the backside of the ice making chamber is not limited to two as in the embodiment. One, three or more may be set properly in accordance with a size of the ice making chamber. According to the embodiment, the cooling tubes are held between two ice making chambers. However, a constitution may be employed in which a cooling tube is arranged on the backside of one ice making chamber.

Figure 13:
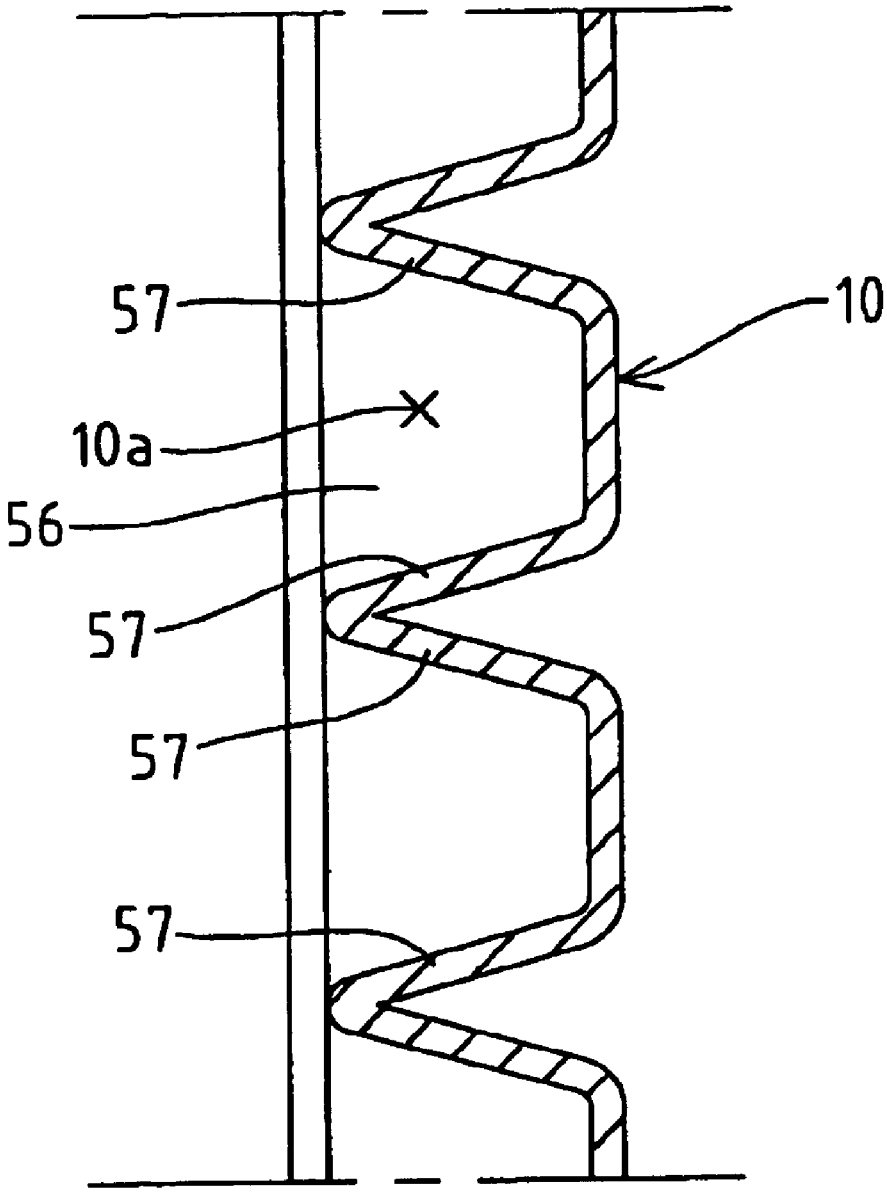
FIG. 13 is an explanatory view showing a modification of the ice making chamber.

The embodiment has been described by way of case in which the lateral partitions facing each other vertically are arranged in parallel to define the ice making compartment. However, as shown in FIG. 13, the horizontal partitions 57, 57 facing each other vertically may be expanded toward the opening side. In this case, removal of the ice cubes from the ice making compartments 10*a* is facilitated.

According to the embodiment, the feeding stop of the deicing water by the first or second feed valve is controlled by the opening completion switch or the deicing completion switch. However, a floating water level switch arranged in the ice making water tank may be used and, when the water level switch detects that the corresponding predetermined amount of ice making water (fed deicing water) has been reserved in the tank, the feeding of the deicing water by the corresponding first or second feed valves may be stopped.

(Second Embodiment)

Next, an automatic ice maker of a second embodiment will be described with reference to FIGS. 14 to 20. Members similar to those of the first embodiment are denoted by similar reference numerals, and detailed description thereof will be omitted.

Figure 14:
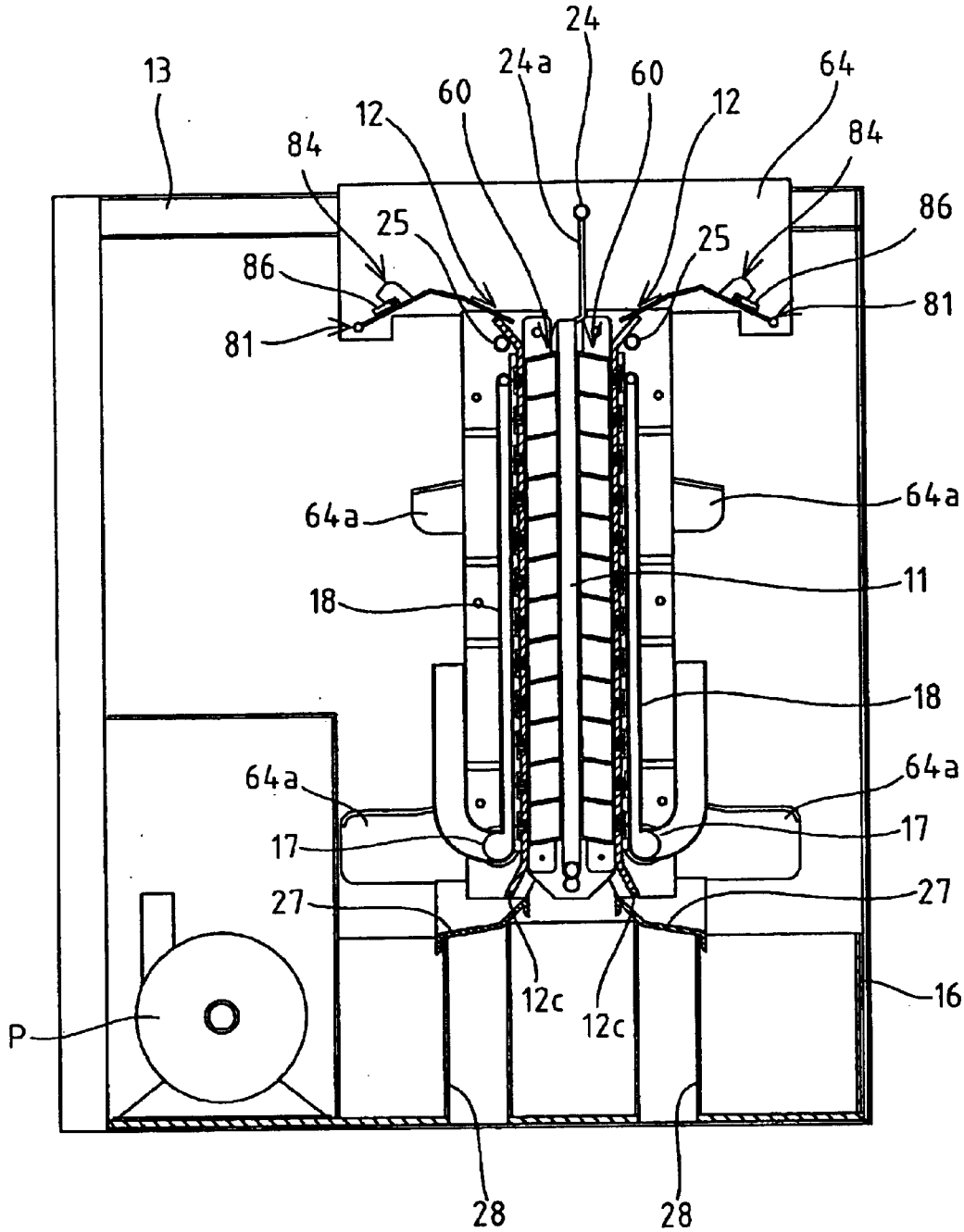
FIG. 14 is a longitudinal front view showing a schematic constitution of an automatic ice maker in an ice making state according to a second embodiment.
Figure 15:
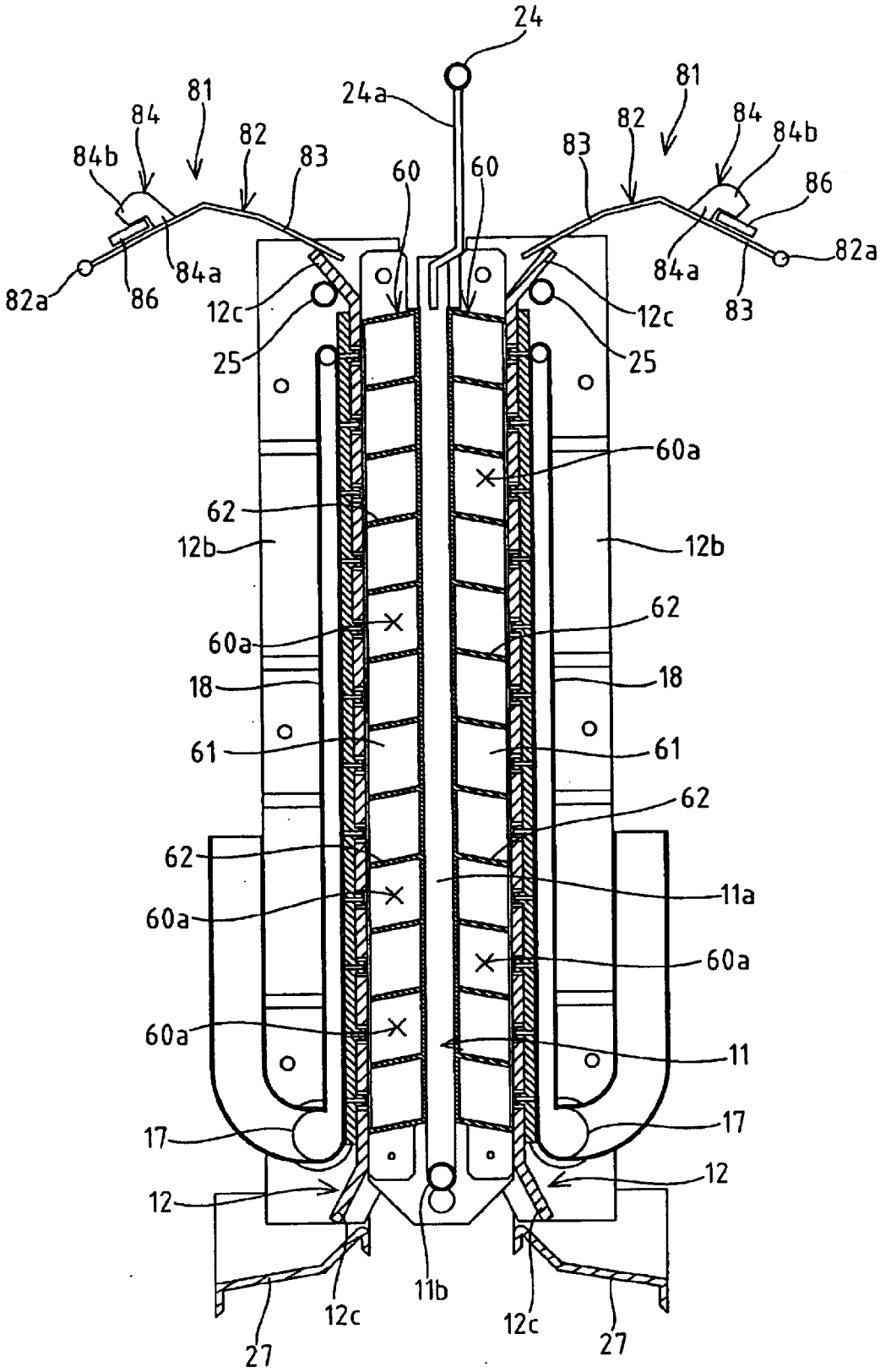
FIG. 15 is a longitudinal front view showing a water tray in a state in which it is positioned in an ice making position with respect to an ice making chamber of the second embodiment.

FIG. 14 schematically shows a main ice making mechanism of the automatic ice maker of the second embodiment in an ice making state. In FIG. 14, the ice making mechanism for making multiple ice cubes (lumps of ice S) of required sizes basically comprises a pair of ice making chambers (ice making sections) 60, 60, which each have a plurality of ice making compartments 60*a* open in an oblique downward direction and which are roughly vertically arranged on ice making chamber brackets 64, 64 so that backsides thereof (sides opposite open sides of the ice making compartments 60*a*) can face each other, a plurality (two in the embodiment) of cooling tubes 11, 11 arranged between the backsides of the ice making chambers 60, 60, and a water tray 12 as an ice making water feeding means to be brought close to and apart from the front surface side (open side of the ice making compartment 60*a*) of each ice making chamber 60. In the ice making chambers 60, 60, as in the case of the first embodiment, vertical and horizontal partitions 61, 62 define the ice making compartments 60*a*, 60*a*. As shown in FIG. 15, the horizontal partition 62 is formed to incline downward in a vertical direction from a deep side to an opening side, and the ice making compartment 60*a* is opened obliquely downward. In the ice making chamber brackets 64, 64 which support the ice making chambers 60, 60, flange portions 64*a*, 64*a* extended in opposite directions are formed in positions apart from each other vertically so that upper end surfaces thereof can be inclined downward to be more apart from the ice making chambers 60, 60. An inclining angle of the upper surface of each flange portion 64*a* roughly matches that of the horizontal partition 62.

Figure 16:
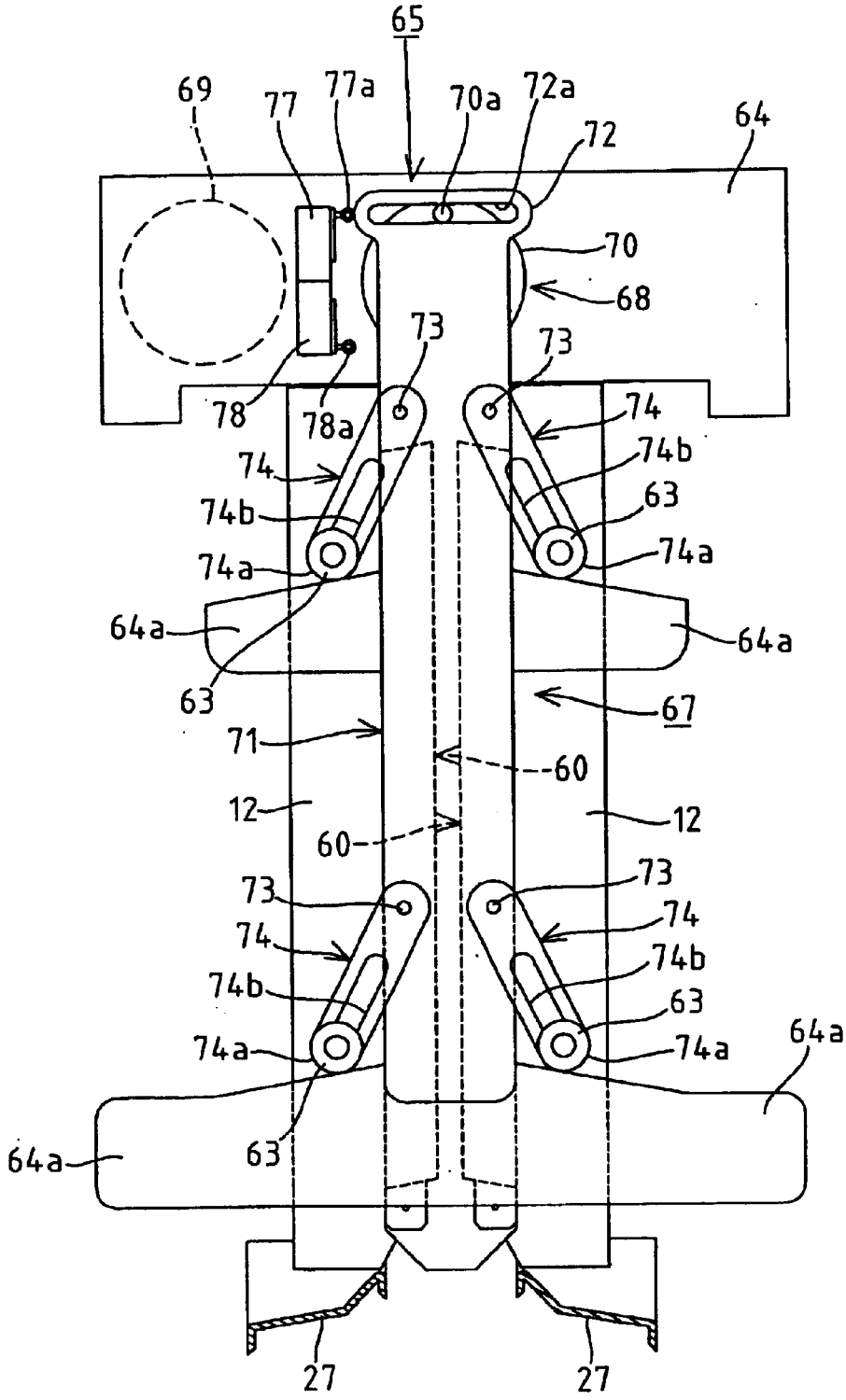
FIG. 16 is a front view showing a state in which a linking mechanism of the second embodiment is held in a first position, and the water tray is positioned in the ice making position.
Figure 17:
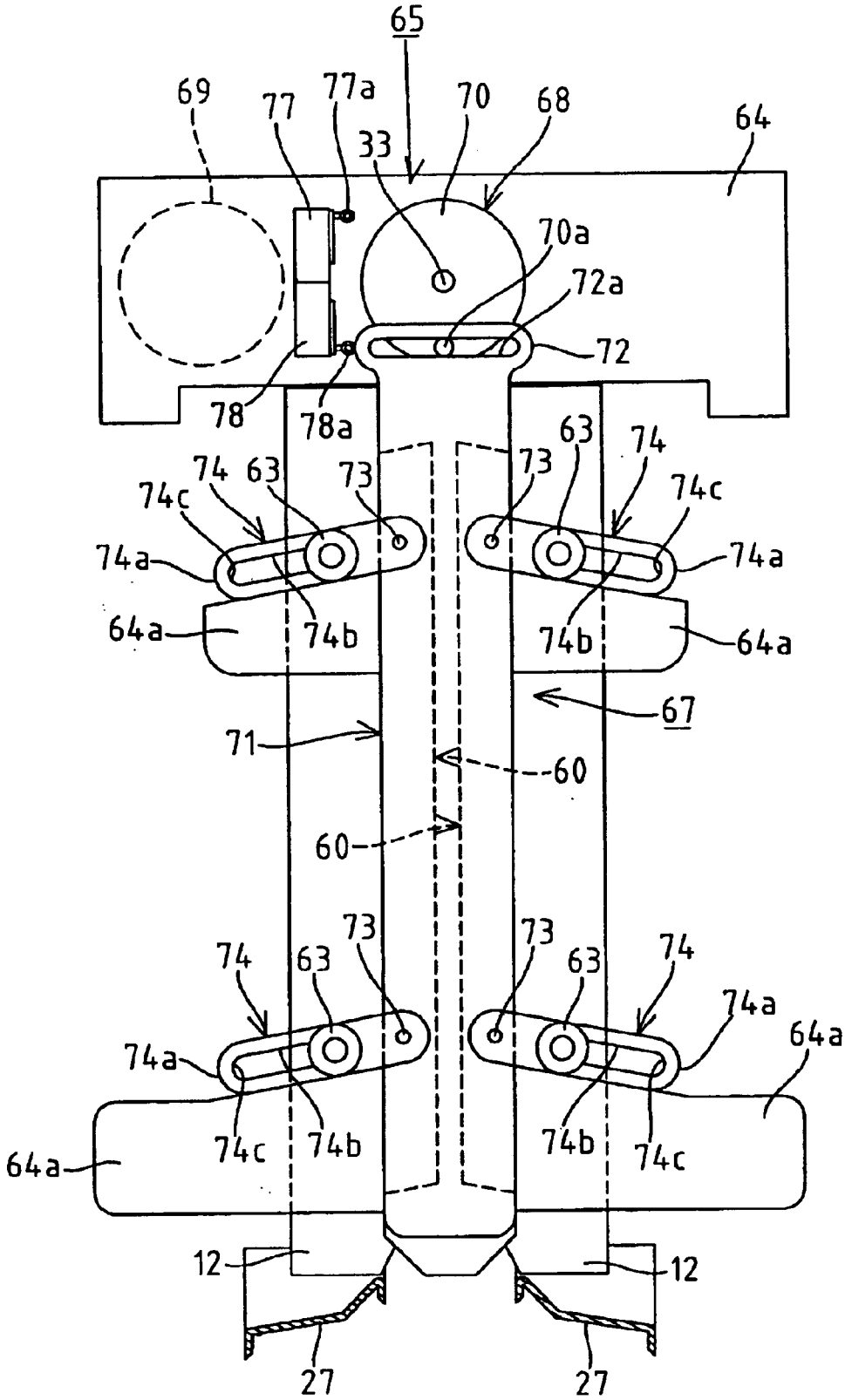
FIG. 17 is a front view showing a state in which the linking mechanism of the second embodiment is displaced to a second position, and the water tray is held in the ice making position.
Figure 18:
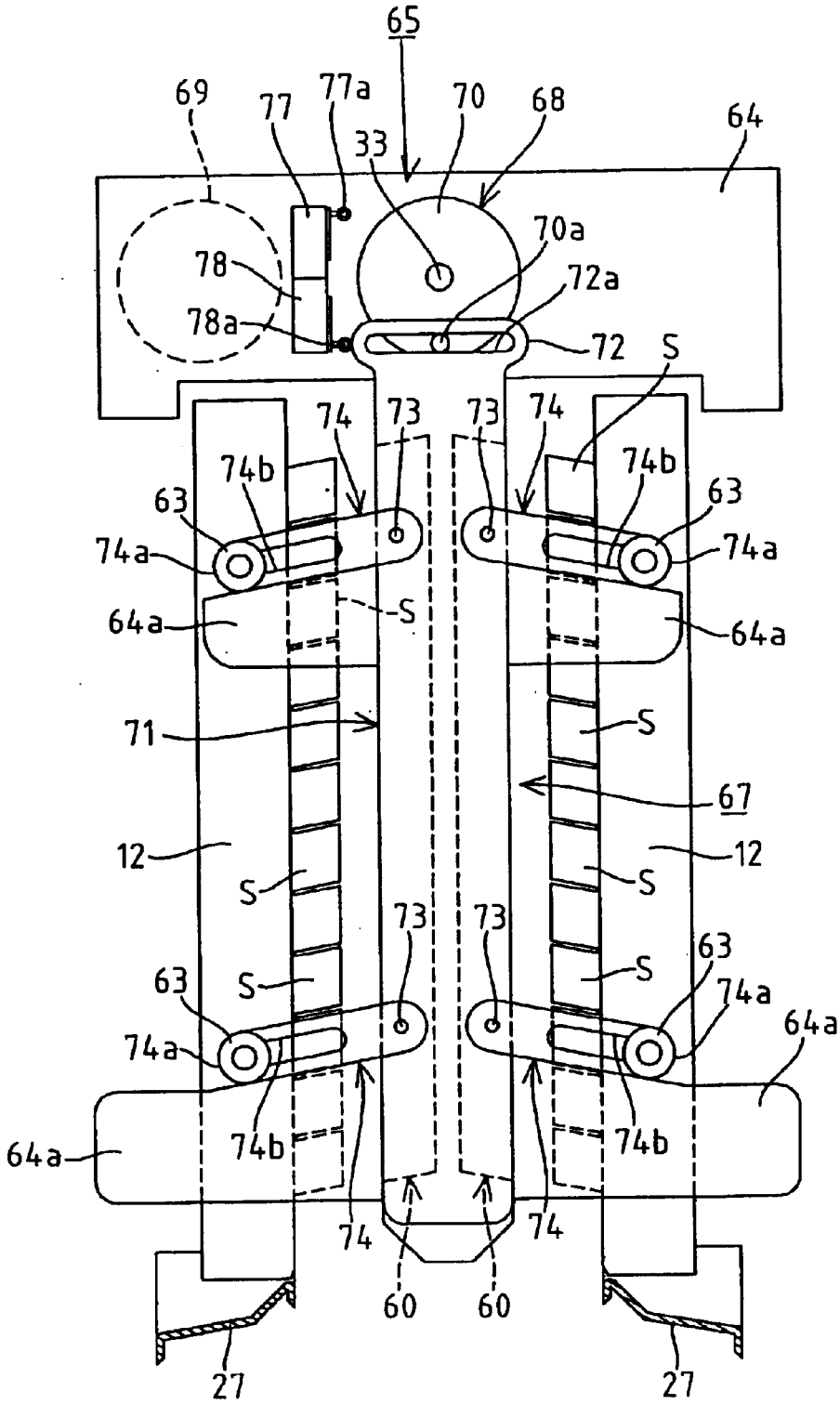
FIG. 18 is a front view showing a state in which the linking mechanism of the second embodiment is held in the second position, and the water tray is moved to an open position.

The ends of the vertical and horizontal partitions 61, 62 on front surface sides are positioned inside by a predetermined length with respect to the front surface ends of the ice making chambers 60, 60 as in the case of the first embodiment. An ice making completion thermostat (not shown) as ice making completion detection means is arranged in each of the ice making chambers 60, 60. When the thermostat detects a reduction of the temperature of the ice making chamber 60 to an ice making completion temperature caused by formation of a roughly complete ice cube S in the ice making compartment 60, the operation completes an ice making operation to transfer to a deicing operation. Further, as shown in FIGS. 16 to 18, pairs of guide rollers (first engaging portions) 63, 63 are rotatably arranged in vertically separated positions of water tray brackets 29, 29 arranged on front and rear side plates 12*b*, 12*b* of the water trays 12, 12. The water trays 12 are laterally moved in parallel in an obliquely downward direction in a longitudinal orientation along the upper end surfaces of the flanges 54*a* in a later-described opening/closing device (opening/closing means) through the guide rollers 63.

As in the case of the first embodiment, during the ice making operation, a refrigerant is circulated to be fed to the cooling tubes 11, 11, and ice making water of the ice making water tank 16 is sprayed through each spout hole 19*a* of a distribution tube 18 to be fed to the ice making compartment 60*a*. After transfer to the deicing operation, the circulated feed of the ice making water to the ice making compartment 60*a* is stopped, a hot gas is fed to the cooling tubes, and deicing water (tap water at a normal temperature) is sprinkled to the backsides of the ice making chambers 60, 60 through a first deicing water sprinkling tube 24.

(Opening/Closing Device)

The opening/closing device 65 comprises a pair of linking mechanisms 67, 67 arranged in both of the ice making chamber brackets 64, 64, and an actuator mechanism 68 for actuating the linking mechanisms 67, 67. The linking mechanisms 67, 67 are operated by the actuator mechanism 68 to move the water trays 12, 12 between the ice making position (see FIG. 19A) close to a front surface side of the corresponding ice making chamber 60 and the open position (see FIGS. 19B and 19C) apart from the front surface side. As in the case of the first embodiment, the actuator mechanism 68 comprises a rotary shaft 33 bridged between upper ends of the ice making chamber brackets 64, 64 so as to be rotated in connection with a motor 69. A disk cam 70 is arranged to be integrally rotated in a shaft end of the rotary shaft 33 protruded outward from each of the ice making chamber brackets 64, 64. That is, the motor 69 is driven to make revolutions to rotate the cam 70 in a predetermined direction (clockwise direction in FIGS. 16 to 18 according to the second embodiment). As shown in FIG. 17 or 18, in the cam 70, a shaft portion 70*a* is disposed to be extended back and forth in a position made eccentric with respect to the rotational center (rotary shaft 33).

(Linking Mechanism)

As the linking mechanisms 67, 67 operated by the actuator mechanism 68 are symmetrical in constitution, only the constitution of the linking mechanism 67 arranged on the front side is described. As shown in FIGS. 16 to 18, the linking mechanism 67 comprises a long slide plate 71 extended in a vertical direction, and four guides 74, 74, 74, 74 pivotally attached to the slide plate 71 to swing. A protrusion 72 is disposed in an upper end of the slide plate 71 to be extended in opposite directions, a guide groove 72*a* is formed in the protrusion 72 to be extended left and right, and the shaft portion 70*a* of the cam 70 is inserted into the guide groove 72*a*. That is, when the cam 70 is rotated, the shaft portion 70*a* is slid along the guide groove 72*a* of the slide plate 71, and the shaft portion 70*a* is vertically displaced to vertically reciprocate the slide plate 71 (see FIGS. 16 to 18). When the ice making operation is carried out, the slide plate 71 is positioned the uppermost. When the deicing operation is carried out, the slide plate 71 is positioned on the lowermost.

On both opposite sides of the slide plate 71, support shafts 73, 73, 73, 73 are disposed in positions apart from one another by required distances vertically, and one end of the guide portion 74 is pivotally attached to each support shaft 73. Accordingly, the free end 74*a* of the guide portion 74 apart from the support shaft 73 is freely rotated. Additionally, the long hole 74*b* of a required length is formed in a position for connecting a rough center of the guide portion 74 with the free end 74*a*. A not-shown shaft portion of the guide roller 63 disposed in the water tray 12 is inserted into the long hole 74*b*. That is, the guide portion 74 is positioned between the water tray 12 and the guide roller 63, and the shaft portion of the guide roller 63 is always engaged with an end edge 74*c* (see FIG. 17) as a second engaging portion to define the long hole 74*b* on the free end side of the guide portion 74.

When the ice making operation is carried out, the linking mechanism 67 is displaced to a first position (see FIG. 16) in which the slide plate 71 is positioned the uppermost as described above, and the end edge 74*c* of the guide portion 74 is engaged with the shaft portion of the guide roller 63 to hold the water tray 12 in an ice making position near the slide plate 71. When the deicing operation is carried out, in the linking mechanism 67, the slide plate 71 is positioned the lowermost as described above. At this time, the water tray 12 is held in the ice making position by freezing between the ice making chamber 60 and the water tray 12, the guide portion 74 is rotated around the shaft portion of the guide roller 63, and the engagement between the end edge 74*c* of the guide portion 74 and the shaft portion of the guide roller 63 is released to displace the linking mechanism to a second position (see FIG. 17 or 18) which permits a movement of the water tray 12 to the open position by its own weight.

When melting occurs (on freezing surface) between the ice making chamber 60 and the ice cube S, the guide rollers 63 are rotated along the upper end surfaces of the flange portions 64*a* to move the water trays 12 in parallel by their own weight, and the shaft portions of the guide rollers 63 are engaged with the end edges 74*c* of the guide portions 74 to hold them in the open positions (see FIG. 18). Then, when a later-described deicing completion detector 81 detects deicing completion, the linking mechanisms 67, 67 are displaced from the second positions to the first positions and, under the engagement between the guide roller 63 of the water tray 12 and the end edge 74*c* of the guide portion 74, the guide roller 63 is moved along the flange portion 64*a* to approach the ice making chamber 60, whereby the water tray 12 is returned from the open position to the ice making position.

(Limit Switch)

As shown in FIGS. 16 to 18, two limit switches 77, 78 are arranged to be vertically adjacent to each other on the side of the cam 70 in the ice making chamber bracket 64 positioned on the front side. The first limit switch (detection means) 77 positioned on an upper side functions to stop and control the motor 69 when the shaft portion 70*a* of the cam 70 arrives at the top dead point (linking mechanism 67 is in the first position) directly above the rotary shaft 33 to bring the protrusion 72 of the slide plate 71 into contact with a detection portion 77*a* of the switch 77 (ON state). In other words, the first limit switch 77 detects that the linking mechanism 67 is displaced to the first position, and the water trays 12, 12 face the ice making potions to enable an ice making operation. The second limit switch 78 positioned on a lower side functions to stop and control the motor 69 when the shaft portion 70*a* of the cam 70 arrives at the bottom dead point (linking mechanism 67 is in the second position) directly below the rotary shaft to bring the protrusion 72 of the slide plate 71 into contact with a detection portion 78 of the switch 78 (ON state).

(Deicing Completion Detector)

As shown in FIG. 14, the deicing completion detector 81 is arranged in each of the ice making chamber brackets 64, 64 to detect deicing from the water tray 12. The deicing completion detector 81 comprises, as shown in FIG. 14, detection members 82, 82 arranged symmetrically to the water trays 12, 12 and pivotally supported on the ice making chamber bracket 64 so as to be rotated, detection sensors 86, 86 for detecting rotations of the detection members 82, 82, and a deicing determination means 87 for determining removal of ice cubes S from the water trays 12, 12 based on changes in detected states of the detection sensors 86, 86. Each detection member 82 comprises a main body 83 bent roughly in an upward curve shape, and a roughly L-shaped detection member 84 detected by the detection sensor 86. In a state in which the protrusion 72 of the main body 83 is positioned on an upper side, the end of the main body 83 apart from the corresponding ice making chamber 60 is pivotally supported on the ice making chamber bracket 64 to swing.

The detection member 84 comprises a support piece 84*a* formed near a shaft part 82 for pivotally supporting the main body 83 to protrude upward, and a detection piece 84*b* extended from an upper end edge of the support piece 84*a* toward the shaft part 82*a* roughly in parallel with the main body 83. In other words, the detection piece 84*b* is positioned to be apart from the main body 83 by a required distance.

Figure 19C:
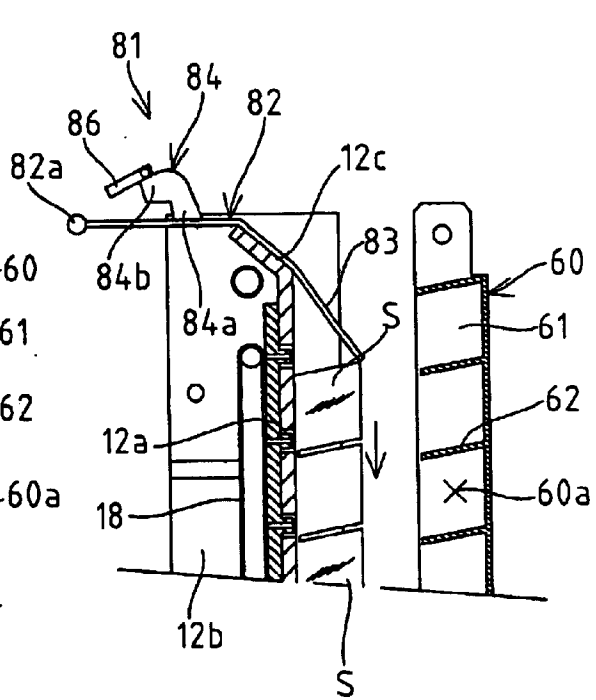
FIGS. 19A to 19C are main portion sectional views showing operations of the water tray and a detection member in the automatic ice maker of the second embodiment.
Figure 19B:
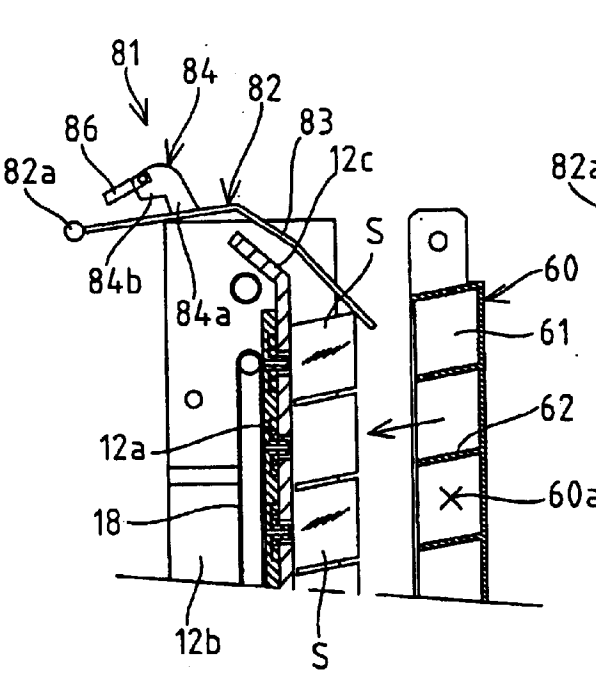
Figure 19A:
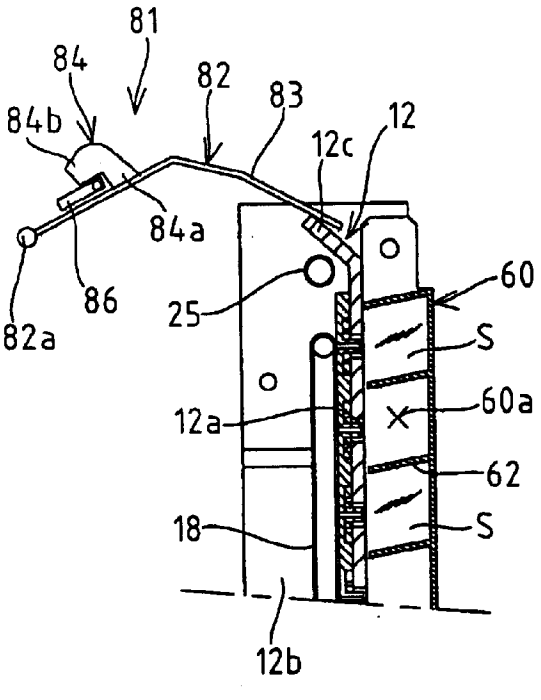
Figure 20:
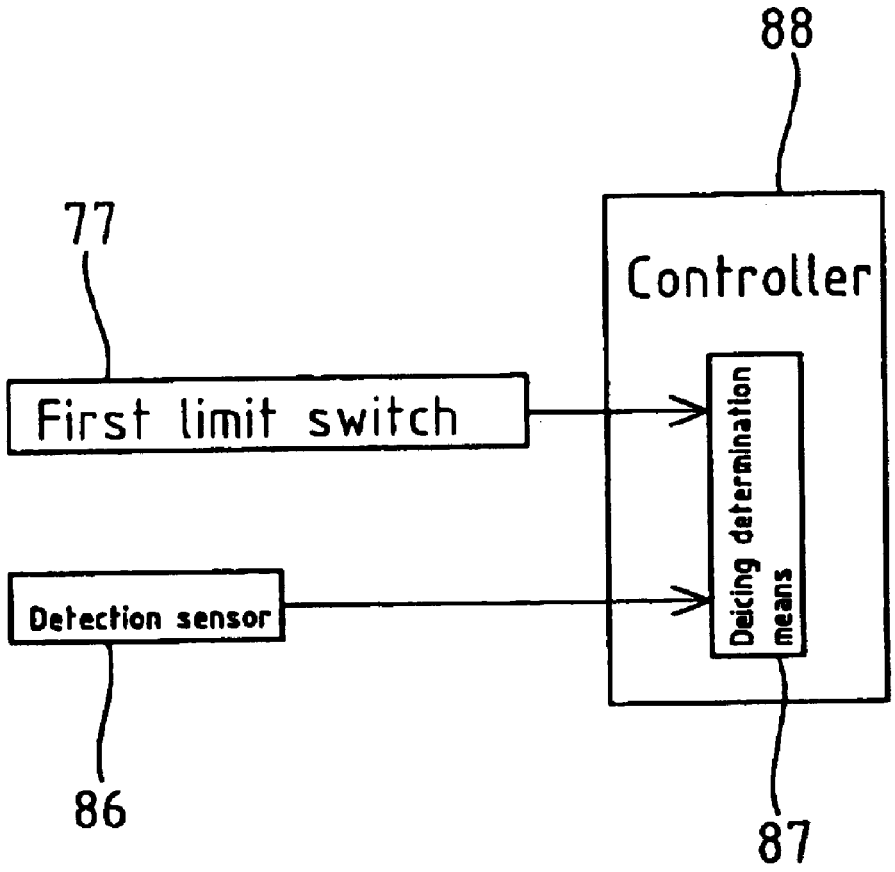
FIG. 20 is a block diagram schematically showing a control system of the automatic ice maker of the second embodiment.

If the water tray 12 is in the ice making position, the detection member 82 is held in a normal state position in which the end of the detection member 82 near the ice making chamber 60 is abutted on the upper bent portion 12*c* of the water tray 12 to be regulated for rotation (see FIG. 19A). When the water tray 12 is laterally moved to the open position, the detection member 82 is accordingly rotated to be held in a deicing start position in which the main body 83 is abutted on an uppermost ice cube S of the ice cubes frozen on the water tray 12 to be regulated for rotation (see FIG. 19B). Further, when the ice cube S is peeled off from the water tray 12, the detection member 82 is released from the position regulation by the ice cube S to be further rotated, and held in a deicing completion position in which the main body 83 is abutted on the bent portion 12*c* of the water tray 12 to be regulated for rotation (see FIG. 19C).

As the detection sensor 86, a typical optical sensor in which a light emission surface of a light emission section and a light receiving surface of a light reception section face each other is used. If the detection member 82 is in the normal state position, this optical sensor is positioned between the main body 83 of the detection member 82 and the detection piece 84*b* to prevent blocking of a light emitted from the light emission section by the detection piece 84*b*. If the detection member 82 is rotated to the deicing start position, the detection piece 84*b* is positioned between the light emission section and the light reception section to block the light emitted from the light emission section, and the detection sensor 86 detects that the detection member 86 is in the deicing start position. Further, if the detection member 82 is rotated to the deicing completion position, the detection sensor 86 is positioned above the detection piece 84*b* to prevent blocking of the light emitted from the light emission section by the detection piece 84*b*.

That is, the detection sensor 86 detects an ON state if the detection member 82 is in the normal state position or the deicing completion position, and an OFF state if the detection member 82 is in the deicing start position. Then, when the water tray 12 is laterally moved to the open position, the OFF state is detected by the detection sensor 86, and opening completion of the water tray 12 is detected. When the left-hand and right-hand detection sensors 86, 86 detect opening completion of the water trays 12, 12, control is carried out to stop the feeding of the deicing water to the backsides of the ice making chambers 60, 60, and the feeding of the hot gas to the cooling tubes 11, 11, and to start feeding deicing water to the backsides of the water trays 12, 12.

The deicing determination means 87 constitutes a part of a controller 88 (see FIG. 20) which controls the automatic ice maker. It is arranged symmetrically to the detector sensor 86, and adapted to identify a change in the detected state of the detection sensor 86 (see FIG. 20). On condition that the detected state of the detection sensor 86 is changed from the ON state to the OFF state, a movement of the water tray 12 to the open position is determined. Then, on condition that the detected state is changed from the OFF state to the ON state, the deicing determination means 87 determines removal of the ice cube S from the water tray 12. Then, based on the determination of the deicing determination means 87, the controller 88 is set to control the opening/closing device 65 and the other components. When the deicing determination means 87 detects the removal of the ice cube S from the water tray 12, the controller 88 stops the feeding of the deicing water to the backsides of the water trays 12, 12 to transfer the operation from deicing to ice making.

A timer means (not shown) is arranged in the controller 88 of the automatic ice maker to set a time (normal time) necessary for the water trays 12, 12 from which the ice cubes S have been normally deiced to return from the open positions to the ice making positions during the transfer from the deicing operation to the ice making operation. If the first limit switch 77 is not turned ON even after the passage of the normal time set by the timer means during the movements of the water trays 12, 12 from the open positions to the ice making positions (displacement of the linking mechanisms 67, 67 from the second positions to the first positions), an abnormality dealing operation is carried out in which the motor 69 is reversely rotated to return the water trays 12, 12 to the open positions (linking mechanisms 67, 67 to the second positions), a hot gas is fed to the cooling tubes 11, 11, and a deicing operation is resumed to sprinkle deicing water to the ice making chambers 60, 60 and the backsides of the water trays 12, 12.

During the abnormality dealing operation, irrespective of deicing completion (state in which the detection member 82 is in the deicing completion position) by the deicing completion detector 81, when reaching of the ice making chambers 60, 60 to a preset releasing temperature is detected by temperature detection means (not shown) arranged in the ice making chambers 60, 60, the deicing operation is switched to the ice making operation by the controller 88, and the linking mechanisms 67, 67 are displaced to the first positions to move the water trays 12, 12 again from the open positions to the ice making positions. If the first limit switch 77 is not turned ON again after the passage of the normal time set by the timer means, the operation transfers to the abnormality dealing again. After the abnormality dealing operation is repeated by a predetermined number of times, the operation of the automatic ice maker is stopped, and an abnormal state is informed to an operator by an alarm sound, displaying or the like. The temperature detection means may detect the temperature of the water tray 12.

(Operation of Second Embodiment)

Next, description will be made of the operation of the automatic ice maker of the second embodiment.

When an ice making operation is carried out, as shown in FIG. 16, the shaft portion 70*a* of the cam 70 in the opening/closing device 65 faces the top, dead point, the end edge 74*c* of the guide portion 74 is engaged with the shaft portion of the corresponding guide roller 63 of the water tray 12, the linking mechanisms 67, 67 are held in the first positions, and the water trays 12, 12 are held in the ice making positions near the front surface sides of the ice making chambers 60, 60. At this time, the first limit switch 77 is in an ON state. In this state, by operating (compressor ON) the freezer, a refrigerant is circulated and fed to the two cooling tubes 11, 11 arranged on the backsides of the ice making chambers 60, 60 and, by the circulation pump P, the ice making water of the ice making water tank 16 is sprayed to be fed through each distribution tube 18 into each ice making compartment 60*a* of the ice making chamber 60. As in the case of the first embodiment, the sprayed ice making water is brought into contract with an inner wall surface of the ice making compartment 60*a* to be cooled, whereby an ice layer is gradually formed. Interconnected ice cubes S corresponding to internal shapes of the ice making compartments 60*a* are finally produced, and frozen to be stuck to the surface of the water tray 12 and the inner wall surfaces of ice making compartments 60*a*.

When the ice making completion thermostat detects that the production of the ice cubes S has been completed and a temperature of each of the ice making chambers 60, 60 has reached an ice making completion temperature, the ice making operation is changed to the deicing operation to stop the circulated feeding of the ice making water. A hot gas is fed to the cooling tubes 11, 11, deicing water (tap water at a normal temperature) is sprinkled through the first deicing water sprinkling tube 24 to the backsides of the ice making chambers 60, 60, and the ice making chambers 60, 60 are heated to start melting frozen surfaces between the inner wall surfaces of the ice making compartments and the ice cubes S. Thus, as in the case of the first embodiment, all the ice cubes S in the ice making chambers 60, 60 are evenly melted to be prevented from becoming partially thin and irregular.

When the ice making completion thermostat detects ice making completion, the motor 69 of the opening/closing device 65 is driven to make revolutions, and clockwise rotation of the cam 70 shown in FIG. 16 is started, whereby the pair of linking mechanisms 67, 67 are actuated. In this case, the water tray 12 is assumed to be held in the ice making position by freezing between the inner wall surface of the ice making compartment 60*a* and the ice cube S. That is, in each linking mechanism 67, the shaft portion 70*a* of the cam 70 is displaced downward to bring about a down-movement of the slide plate 71, the guide 74 pivotally attached to the slide plate 71 is inclined to be displaced around the guide roller 63 of the water tray 12, and the shaft portion of the guide roller 63 is moved apart from the end edge 74*c* of the guide 74 (see FIG. 17). The protrusion 72 of the slide plate 71 is brought into the detection portion 78*a* of the second limit switch 78 to temporarily stop the motor 69, and the linking mechanisms 67, 67 are held in the second positions.

When the ice making chambers 60, 60 are heated to reduce the sticking of the ice cubes S to the ice making compartments 60*a*, in a state in which the groups of ice cubes are frozen on the water trays 12, 12, the guide rollers 63 are rotated along the ramps of the flange portions 64*a* by own weights of the water trays 12, 12 and the ice cubes S to laterally move the water trays 12, 12 in parallel, and the shaft portion of each guide roller 63 is engaged with the end edge 74*c* of the guide 74. That is, the ice cubes S are removed from the ice making compartments 60*a*, 60*a*, and the water tray 12 is held in the open position as shown in FIG. 18. Thus, since the ice cubes S are removed after the sticking between the ice making compartments 60*a* and the ice cubes S is reduced, the ice making chambers 60, 60 and their supporting mechanism portions can be set low in strength to lower the manufacturing costs. Moreover, since the water trays 12 are moved to the open positions by own weight of the water trays 12, 12 and the ice cubes S, unlike the conventional case, it is not necessary to carry out control in which a possibility of separation of the ice cubes from the ice making chamber is detected based on a temperature, by a timer or the like to open the water tray. Thus, the control system can be simplified, and the structure is simplified to enable downsizing of the ice maker. Since it is not necessary to arrange elastic members for moving the water trays 12, 12 to the open positions as in the case of the first embodiment, manufacturing costs can be kept low.

When the water tray 12 arrives at the open position, the detection member 82 is rotated to be held in the deicing start position, and the detection sensor 86 detects an OFF state. Accordingly, the positioning of the water tray 12 in the open position is detected, the feeding of the deicing water to the backsides of the ice making chambers 60, 60 and the feeding of the hot gas to the cooling tubes 11, 11 are stopped, and then water is sprinkled through the second deicing water sprinkling tube 25 to the backsides of the water trays 12. Thus, each water tray 12 is heated to reduce the freezing with the ice cubes S frozen on its front surface side. The ice cubes S fall by their own weight to be stored through the ice passage port 28 in the ice storage.

When the ice cubes S are peeled off to fall from the surface of the water tray 12, the detection member 82 regulated for rotation by the ice cubes S is rotated, abutted again on the water tray 12 to be held in the deicing completion position in which rotation is regulated, and the detection sensor 86 detects an ON state. At this time, sine the second limit switch 78 is in an ON state, the detection member 82 is held in the normal state position to prevent erroneous detection. Further, since the detected state of the detection sensor 86 is changed from the ON state to the OFF state, and then changed from the OFF state to the OFF state, removal of the ice cubes S from the water tray 12 is determined by the deicing determination means 87. Thus, it is possible to surely detect the peeing-off and falling of the ice cubes S from the water tray 12. According to the second embodiment, since the deicing operation is changed to the ice making operation when both left-hand and right-hand deicing determination means 87, 87 detect removal of the ice cubes S from the water trays 12, 12, no transfer is made to the ice making operation while the ice cubes S are frozen on one water tray 12. Additionally, since the detection member 82 is rotated when the ice cubes S are peeled off to fall, it is possible to accurately detect the rotational position of the detection member 82 by the detection sensor 86, and to immediately transfer to the ice making operation after the ice cubes S are peeled-off to fall.

That is, unlike the conventional temperature detector, timer or the like, no operation setting value is set in view of safety to prolong the deicing operation more than necessary. Thus, ice making capability can be improved. Moreover, since the opening completion of the water tray 12 and the peeling-off and falling (deicing completion) of the ice cubes S from the water tray 12 can be detected by the pairs of detection members 82, detection sensors 86 and deicing determination means 87 arranged corresponding to the water tray 12, the number of components can be reduced to lower the manufacturing costs.

In the automatic ice maker of the second embodiment, when the deicing operation is carried out, a plurality of ice cubes S produced in the ice making compartments 60*a* of the ice making chambers 60, 60 are interconnected by the ice layers formed in gaps between the vertical and horizontal partitions 61, 62 and the water tray 12, and these ice cubes are peeled off to fall to the water tray 12 in the frozen state. Thus, scattered falling of the ice cubes S is prevented. In other words, if the ice cubes fall in a scattered manner, the detection member 82 is rotated in a state in which the ice cubes S are left and stuck to part of the water tray 12, an error of the deicing completion is detected by the deicing determination means 87, and the ice cubes S are prevented from being caught between the ice making chambers 60, 60 and the water tray 12.

When the deicing completion is detected, the motor 69 of the opening/closing device 65 is driven to make revolutions to rotate the cam 70 clockwise, and the shaft portion 70*a* of the cam 70 is displaced upward to bring about an up-movement of the slide plate 71. Then, the protrusion 72 of the slide plate 71 is brought into contact with the detection portion 77*a* of the first limit switch 77 to temporarily stop the motor 69, and the linking mechanisms 67, 67 are changed from the second positions to the first positions. At this time, as the shaft portion of the guide roller 63 of the water tray 12 is engaged with the end edge 74*c* of the guide portion 74, in association with the displacement of the linking mechanisms 67, 67 from the second positions to the first positions, the water tray 12 is returned from the open position to the ice making position. Thus, the positioning of the water tray 12 in the ice making position is accurately detected to start the ice making operation.

During the transfer from the deicing operation to the ice making operation, if the first limit switch 77 is not turned ON even after the passage of the normal time set by the timer means, the motor 69 is reversely rotated to return the water trays 12, 12 to the open positions (linking mechanisms 67, 67 to the second positions), and an abnormality dealing operation is carried out. Thus, even if the ice cubes S are stuck between the ice making chambers 60, 60 and the water trays 12, 12, it is possible to prevent damaging of the motor 69, the ice making chambers 60, 60, the water trays 12, 12 etc. Moreover, when the abnormality dealing operation is repeated by a predetermined number of times, the operation of the automatic ice maker is stopped, and an abnormal state is informed to an operator. Thus, application of an excessive load on the ice maker can be prevented. During the abnormality dealing operation, when reaching of the ice making chambers 60, 60 to a preset releasing temperature is detected by the temperature detection means, the motor 69 of the opening/closing device 65 is driven to make revolutions to switch from the deicing operation to the ice making operation. Accordingly, it is possible to carry out more reliable deicing detection. Furthermore, since the ice making operation is started after the water trays 12, 12 are moved to the ice making positions near the ice making chambers 60, 60, it is possible to efficiently cool the water trays 12, 12, and to increase efficiency of the ice making operation.

What is claimed is:

1. An automatic ice maker comprising:

a longitudinally arranged ice making section having multiple ice making compartments open in a horizontal direction;

a cooling tube which is arranged on a backside of the ice making section to be in close contact therewith and through which a refrigerant is circulated when an ice making operation is carried out and a high-temperature refrigerant gas is circulated when a deicing operation is carried out; and ice making water feeding means positioned in ice making positions for closing the ice making compartments when the ice making operation is carried out to feed ice making water to the ice making compartments, thereby producing lumps of ice, and laterally moved in parallel to an open position for opening the ice making compartments by opening/closing means (15) when the deicing operation is carried out, wherein the ice making water feeding means are laterally moved to the open positions while the lumps of ice are frozen thereto to remove the lumps of ice from the ice making compartments when the deicing operation is carried out, and the lumps of ice are deiced from the ice making water feeding means in the open positions.

2. An automatic ice maker comprising:

a longitudinally arranged ice making section having an ice making compartment open in an obliquely downward direction, which is cooled when an ice making operation is carried out, and heated when a deicing operation is carried out;

an ice making water feeding means positioned in an ice making position for closing the ice making compartment when the ice making operation is carried out to feed ice making water to the ice making compartment, thereby producing a lump of ice, and set apart from the ice making section to be laterally moved to the open position for opening the ice making compartment when the deicing operation is carried out; and an opening/closing means which comprises a second engaging section to be engaged with a first engaging section of the ice making water feeding means, and which is displaceable between a first position for engaging the second engaging section with the first engaging section to hold the ice making water feeding means in the ice making position when the ice making operation is carried out and a second position for disengaging the second engaging section from the first engaging section to laterally move the ice making water feeding means to the open position by its own weight when the deicing operation is carried out, wherein when a frozen surface between the ice making section and the lump of ice heated by the deicing operation is melted after the second engaging section is displaced from the first position to the second position by the opening/closing means, the ice making water feeding means is laterally moved by its own weight while the lump of ice is frozen to be held in the open position for engaging the first engaging section with the second engaging section, and wherein the ice making water feeding means is laterally moved from the open position to the ice making position under the engaging action between the first engaging section and the second engaging section when the second engaging section is displaced from the second position to the first position by the opening/closing means.

3. The automatic ice maker according to claim 1, wherein lateral partitions vertically facing each other are arranged in the ice making section to define the ice making compartments, and set to be parallel to each other or expanded toward the opening side.

4. The automatic ice maker according to claim 1 or 3, wherein the opening/closing means comprises an elastic member for urging the ice making water feeding means in a direction to approach the ice making section when the ice making operation is carried out, and urging the ice making water feeding means in a direction to be apart from the ice making section when the operation transfers to deicing, and the ice making water feeding means is moved between the ice making position and the open position through the elastic member.

5. The automatic ice maker according to claim 1 or 2, wherein an ice making water tank is arranged below the ice making section and, in the ice making water tank, an ice passage port is disposed in a position directly below the lumps of ice frozen in the ice making water feeding means moved to the open position.

6. The automatic ice maker according to claim 5, further comprising a guiding means for guiding, to the ice making water tank, ice making water fed to the ice making compartment to flow down without being frozen when the ice making operation is carried out and deciding water fed to the backside of the ice making water feeding means to flow down when the deicing operation is carried out and a cover means disposed below the guiding means to cover the ice passage port.

7. The automatic ice maker according to claim 1 or 2, wherein the frozen surfaces of the lumps of ice of the ice making water feeding means are formed to be flat, and the ice making water feeding means comprises a deicing means for releasing freezing with the lumps of ice.

8. The automatic ice maker according to claim 1 or 2, wherein a pair of ice making sections are arranged opposite to each other across the cooling tube.

9. A method for operating an automatic ice maker, the automatic ice maker comprising: a longitudinally arranged ice making section which is cooled when an ice making operation is carried out, and heated when a deicing operation is carried out; and a plurality of ice making water feeding means which face an ice making position close to the ice making section to produce a lump of ice between the means and the ice making section during the ice making operation, and laterally move to an open position to be apart from the ice making section by switching to a deicing operation, the method comprising:

moving the ice making water feeding means while the lump of ice is frozen, and heating the ice making water feeding means to deice the lump of ice when the deicing operation is carried out; and carrying out an operation to deal with an abnormality, which returns the ice making water feeding means to the open position to resume the deicing operation if a detection means for detecting an arrival of the ice making water feeding means at the ice making position is not set in a detection state even after the passage of normal time necessary from a start of movement of the ice making water feeding means of the open position toward the ice making position by transfer from the deicing operation to an ice making operation to return of the ice making water feeding means after normal deicing of the lump of ice to the ice making position.

10. The method according to claim 9, wherein the operation is switched from deicing to ice making when temperature detection means detects that the ice making water feeding means returned to the open position to be heated reaches a preset releasing temperature during the abnormality dealing operation.

11. The method according to claim 9 or 10, wherein the operation is stopped if the abnormality dealing operation is repeated by a predetermined number of times.

* * * * *